US011804676B2

(12) United States Patent
Amemori et al.

(10) Patent No.: US 11,804,676 B2
(45) Date of Patent: Oct. 31, 2023

(54) ELECTRIC CONNECTOR SET

(71) Applicant: Murata Manufacturing Co., Ltd., Kyoto-fu (JP)

(72) Inventors: Yuma Amemori, Nagaokakyo (JP); Aoi Tanaka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 17/129,881

(22) Filed: Dec. 21, 2020

(65) Prior Publication Data

US 2021/0111521 A1 Apr. 15, 2021

Related U.S. Application Data

(63) Continuation of application No. PCT/JP2019/017833, filed on Apr. 26, 2019.

(30) Foreign Application Priority Data

Jun. 27, 2018 (JP) ..... 2018-122470

(51) Int. Cl.
*H01R 13/6585* (2011.01)
*H01R 13/639* (2006.01)

(52) U.S. Cl.
CPC ..... *H01R 13/6585* (2013.01); *H01R 13/639* (2013.01)

(58) Field of Classification Search
CPC ..... H01R 13/6585; H01R 13/639; H01R 13/6587

(Continued)

(56) References Cited

U.S. PATENT DOCUMENTS 3,871,728 A * 3/1975 Goodman ..... H01R 13/6585 439/62
4,616,893 A * 10/1986 Feldman ..... H01R 12/7088 439/83

(Continued)

FOREIGN PATENT DOCUMENTS

JP H06-29047 U 4/1994
JP H11-329594 A 11/1999

(Continued)

OTHER PUBLICATIONS

An Office Action; "Notice of Reasons for Refusal," mailed by the Japanese Patent Office dated Feb. 9, 2021, which corresponds to Japanese Patent Application No. 2019-228241 and is related to U.S. Appl. No. 17/129,881 with English language translation.

(Continued)

*Primary Examiner* — Neil Abrams
(74) *Attorney, Agent, or Firm* — Studebaker & Brackett PC

(57) ABSTRACT

An electric connector set includes a first engaging terminal having spring engagement of a first projecting terminal of a first connector and a first recessed terminal of a second connector, a second engaging terminal having spring engagement of a second projecting terminal of the first connector and a second recessed terminal of the second connector, and disposed in a first direction, and a wall-shaped terminal disposed between the first and second engaging terminals in the first direction, extends along a second direction crossing the first direction and a fitting direction over a region including an outer shape of a projection region in the first direction where the first projecting and recessed terminals are spring-engaged, and has a similar height as the electric connector set. Locking mechanisms to retain connector engagement may be used (Continued)

and may be formed of a same member as the wall shaped terminal.

22 Claims, 17 Drawing Sheets

(58) Field of Classification Search
USPC ..... 439/607.09
See application file for complete search history.

(56) References Cited

U.S. PATENT DOCUMENTS 4,695,106 A * 9/1987 Feldman ..... H01R 12/714 439/876
4,824,383 A * 4/1989 Lemke ..... H01R 24/60 439/108
4,836,791 A * 6/1989 Grabbe ..... H01R 23/6873 439/95
5,046,960 A * 9/1991 Fedder ..... H01R 12/724 439/607.07
5,183,405 A * 2/1993 Elicker ..... H01R 12/714 439/947
5,195,899 A * 3/1993 Yatsu ..... H01R 13/6474 439/607.07
5,201,664 A * 4/1993 Korsunsky ..... H01R 12/716 439/892
5,238,414 A * 8/1993 Yaegashi ..... H01R 13/6585 439/607.06
5,403,206 A * 4/1995 McNamara ..... H01R 13/6585 439/607.11
5,645,436 A * 7/1997 Shimizu ..... H01R 13/6585 439/607.11
5,660,551 A * 8/1997 Sakurai ..... H01R 13/6585 439/607.1
5,813,871 A * 9/1998 Grabbe ..... H01R 12/00 439/607.07
6,095,821 A * 8/2000 Panella ..... H01R 13/6585 439/60
6,129,555 A * 10/2000 Daikuhara ..... H01R 12/721 439/607.05
6,247,970 B1 * 6/2001 Ueno ..... H01R 13/6585 439/607.05
6,250,935 B1 * 6/2001 Mochizuki ..... H01R 13/658 439/74
6,328,602 B1 * 12/2001 Yamasaki ..... H01R 13/6471 439/607.11
6,336,826 B1 * 1/2002 Kraft ..... H01R 13/6463 439/502
6,338,635 B1 * 1/2002 Lee ..... H01R 13/6585 439/607.11
6,464,537 B1 * 10/2002 Letourneau ..... H01R 12/714 439/607.14
6,533,614 B1 * 3/2003 Akama ..... H01R 13/6585 439/607.05
6,565,369 B1 * 5/2003 Schulz ..... H01R 12/714 439/108
6,645,005 B2 * 11/2003 Wu ..... H01R 12/707 439/74
6,666,696 B1 * 12/2003 Wu ..... H01R 12/725 439/607.05
6,672,887 B1 * 1/2004 Yu ..... H01R 13/6582 439/108
6,899,566 B2 * 5/2005 Kline ..... H01R 13/6587 439/607.06
6,923,664 B2 * 8/2005 Ito ..... H01R 13/6585 439/607.05
6,942,525 B2 * 9/2005 Olson ..... H01R 13/422 439/660
6,974,225 B2 * 12/2005 Weng ..... A43B 3/36 340/815.45
6,981,898 B2 * 1/2006 Akama ..... H01R 12/00 439/931
7,150,652 B1 * 12/2006 Jeon ..... H01R 12/725 439/76.1
7,488,188 B2 * 2/2009 Moriyama ..... H01R 13/26 439/108
8,540,525 B2 * 9/2013 Regnier ..... H01R 13/646 439/79
8,790,122 B2 * 7/2014 Malehorn, II ..... H01R 24/84 439/83
9,397,423 B2 * 7/2016 Suzuki ..... H01R 12/716
10,170,849 B2 * 1/2019 Tanaka ..... H01R 12/7058
10,361,519 B2 * 7/2019 Chuang ..... H01R 13/41
10,446,985 B2 * 10/2019 Ooi ..... H01R 13/6597
11,075,475 B2 * 7/2021 Chen ..... H01R 13/6585
2003/0060086 A1 * 3/2003 Ozai ..... H01R 43/0263 439/660
2018/0069331 A1 3/2018 Hirakawa et al.
2018/0175561 A1 6/2018 Chen
2021/0111521 A1 * 4/2021 Amemori ..... H01R 13/639

FOREIGN PATENT DOCUMENTS

JP 3086881 U 7/2002
JP 2009-517802 A 4/2009
JP 2015-230840 A 12/2015
TW 201530919 A 8/2015
TW 201817094 A 5/2018
WO 2007/063636 A1 6/2007

OTHER PUBLICATIONS

An Office Action mailed by Taiwan Intellectual Property Office dated Dec. 11, 2020, which corresponds to Taiwanese Patent Application No. 108122088 and is related to U.S. Appl. No. 17/129,881 with English anguage translation.
International Search Report issued in PCT/JP2019/017833; dated Jun. 11, 2019.
Written Opinion issued in PCT/JP2019/017833; dated Jun. 11, 2019.

* cited by examiner

ELECTRIC CONNECTOR SET

CROSS-REFERENCE TO RELATED APPLICATIONS

This application claims benefit of priority to International Patent Application No. PCT/JP2019/017833, filed Apr. 26, 2019, and to Japanese Patent Application No. 2018-122470, filed Jun. 27, 2018, the entire contents of each are incorporated herein by reference.

BACKGROUND

Technical Field

The present disclosure relates to an electric connector set configured by making a first connector and a second connector face each other and fitting them.

Background Art

Conventionally, a connector set in which a pair of connectors are fitted and a row of a multi-pole connector is disposed is known, as described, for example, Japanese Patent Application Laid-Open No. 2015-230840. In this connector set, an annular fixing terminal connected to a ground potential and a connection terminal are disposed in a coplanar configuration when a pair of connectors are fitted so that noise immunity is improved and impedance matching is performed. In this case, the fitting is maintained by pressure contact of the annular fixing terminal with a male connector and a female connector. Further, the connection terminal is pulled out to the outer side than the fixing terminal.

SUMMARY

In a case where an electric connector set is used for transmission of a high frequency signal, there is a problem that resonance is likely to occur in a terminal (GND terminal) connected to the ground potential disposed next to a terminal for transmitting a high frequency signal due to an electric field radiated and fed by the terminal for transmitting a high frequency signal depending on a transmission band, generating radiation noise and interfering with signal transmission.

In view of the above, the present disclosure provides an electric connector capable of suppressing resonance of a terminal even in high frequency transmission.

The electric connector set according to the present disclosure is an electric connector set configured by making a first connector and a second connector face each other and fitting the first connector and the second connector. The electric connector set includes a first engaging terminal that is configured by spring engagement of a first projecting terminal of the first connector and a first recessed terminal of the second connector; and a second engaging terminal that is configured by spring engagement of a second projecting terminal of the first connector and a second recessed terminal of the second connector, and disposed along a first direction with respect to the first engaging terminal. The electric connector set further includes a wall-shaped terminal that is disposed between the first engaging terminal and the second engaging terminal in the first direction, extends along a second direction crossing the first direction and a fitting direction over a region including an outer shape of a projection region in the first direction of a portion where the first projecting terminal of the first connector of the first engaging terminal and the first recessed terminal of the second connector are spring-engaged, and has almost the same height as the height in a fitting direction of the electric connector set.

According to the electric connector according to the present disclosure, a wall-shaped terminal is provided between a first engaging terminal used for high frequency transmission and other second engaging terminals, so that resonance of the terminal can be suppressed even in high frequency transmission.

DETAILED DESCRIPTION

Figure 1A:
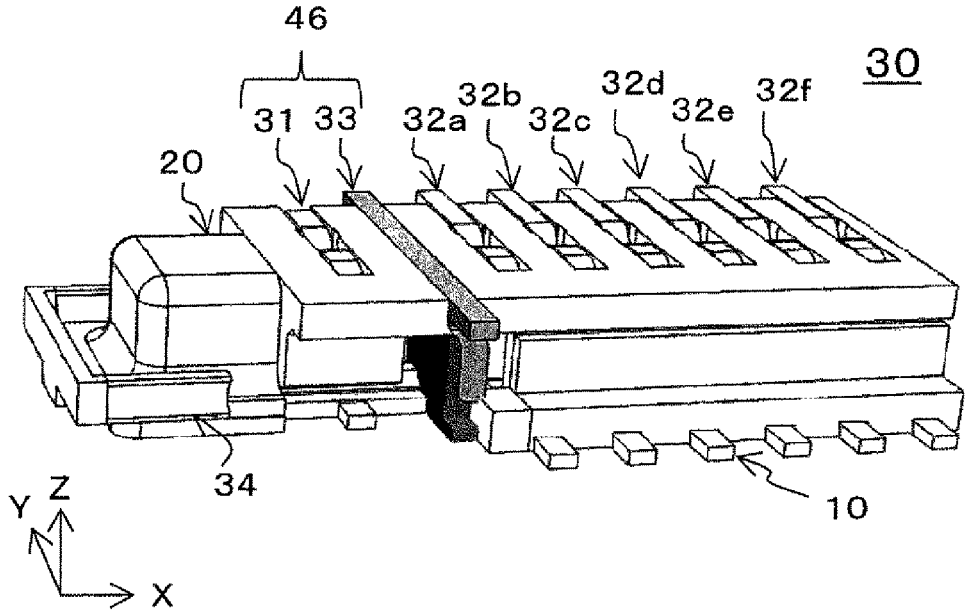
FIG. 1A is a schematic perspective view of an electric connector set according to a first embodiment.

As mentioned in the problem described above, in a high transmission band of a high frequency transmission or the like, for example, in a millimeter wave signal transmission, resonance is likely to occur in a terminal (GND terminal) connected to the ground potential disposed next to a terminal for transmitting a high frequency signal due to an electric field radiated and fed by the terminal for transmitting a high frequency signal, generating radiation noise and interfering with signal transmission. In the configuration of the spring engagement, the wiring distance from a first projecting terminal and a first recessed terminal to a soldered portion of a GND terminal is long. Due to this configuration of the spring engagement, an electric field radiated and fed from the signal transmission line generates resonance in a frequency band according to a wavelength in the soldered portion of the GND terminal, generating radiation noise and interfering with the transmission of a signal at a first engaging terminal.

In view of the above, the present inventor has found that the resonance of the terminal can be suppressed even in high frequency transmission by providing a wall-shaped terminal having the same height as the height in the fitting direction of the electric connector set between the first engaging terminal and a second engaging terminal, and arrived at the present disclosure. Further, the present inventor has found that it is more preferable if the wall-shaped terminal extends in the y-axis direction over a region including an outer shape of a projection region of a portion where the first projecting terminal and the first recessed terminal constituting the first engaging terminal from the x-axis direction are spring-engaged. In the present disclosure, "the same height as the height in the fitting direction of the electric connector set" does not mean that the height is exactly the same as the height in the fitting direction of the electric connector set, and includes the height almost the same as the height in the fitting direction of the electric connector set in view of a manufacturing tolerance and the like.

The electric connector set according to a first aspect is an electric connector set configured by making a first connector and a second connector face each other and fitting the first connector and the second connector. The electric connector set includes a first engaging terminal that is configured by spring engagement of a first projecting terminal of the first connector and a first recessed terminal of the second connector, a second engaging terminal that is configured by spring engagement of a second projecting terminal of the first connector and a second recessed terminal of the second connector, and disposed along a first direction with respect to the first engaging terminal, and a wall-shaped terminal that is disposed between the first engaging terminal and the second engaging terminal in the first direction, extends along a second direction crossing the first direction and a fitting direction over a region including an outer shape of a projection region in the first direction of a portion where the first projecting terminal of the first connector of the first engaging terminal and the first recessed terminal of the second connector are spring-engaged, and has almost the same height as the height in a fitting direction of the electric connector set.

According to the above configuration, the wall-shaped terminal is provided between the first engaging terminal used for high frequency transmission and the other second engaging terminals, so that resonance of the terminal can be suppressed even in high frequency transmission.

In the electric connector set according to a second aspect, in the first aspect, the wall-shaped terminal may be made from a metal material and is connected to the ground potential.

In the electric connector set according to a third aspect, the first or second aspect, the wall-shaped terminal may have a planar shape including an outer shape of a projection region of the first engaging terminal from the first direction.

In the electric connector set according to a fourth aspect, in any of the first to third aspects, the wall-shaped terminal may be provided on at least one of the first connector and the second connector.

In the electric connector set according to a fifth aspect, in any of the first to fourth aspects, the wall-shaped terminal may be configured by engagement of a first partial wall terminal of the first connector and a second partial wall terminal of the second connector.

In the electric connector set according to a sixth aspect, in the fifth aspect, at least one of the first partial wall terminal and the second partial wall terminal may be elastically deformable.

With the above configuration, when the first partial wall terminal and the second partial wall terminal are engaged, at least one of the terminals is elastically deformed even if stress is applied, so that the first partial wall terminal and the second partial wall terminal can be stably engaged. Further, the electric connection can be stabilized.

In the electric connector set according to a seventh aspect, in the sixth aspect, blocks formed of the first engaging terminal and the wall-shaped terminal may be provided in two locations along the first direction, and, regarding a length A in the first direction between the first partial wall terminals of the blocks of the first connector and a length B in the first direction between the second partial wall terminals of the blocks of the second connector, a relationship of the length A in the first direction<the length B in the first direction may be established.

In the electric connector set according to an eighth aspect, in any of the first to sixth aspects, blocks formed of the first engaging terminal and the wall-shaped terminal may be provided in two locations along the first direction.

With the above configuration, the number of transmission signal lines can be increased.

The electric connector set according to a ninth aspect may further include, in the sixth aspect, a fixing terminal having a locking mechanism for holding the first connector and the second connector. The fixing terminal may be configured in such a manner that a projecting curved surface of a projecting fixing terminal of the first connector and a recessed curved surface of a recessed fixing terminal of the second connector are in contact with each other, and, regarding a length C in the first direction of an inner side of the projecting curved surface of the first connector and the first partial wall terminal and a length D in the first direction of an inner side of the recessed curved surface of the second connector and the second partial wall terminal, a relationship of the length C in the first direction>the length D in the first direction may be established.

The electric connector set according to a tenth aspect may further include, in any of the first to eighth aspects, a fixing terminal having a locking mechanism for holding the first connector and the second connector in the fitting direction.

With the above configuration, the second connector can be received on a lowest possible surface after fitting, and a height fluctuation after fitting can be suppressed. Therefore, the impedance of the transmission signal line can be easily adjusted.

In the electric connector set according to an eleventh aspect, in the tenth aspect, the fixing terminal may be configured in such a manner that a metal surface of a projecting fixing terminal of the first connector and a metal surface of a recessed fixing terminal of the second connector are in contact with each other.

With the above configuration, the resonance generated between the fixing terminal and the substrate of the electric connector set can be suppressed.

In the electric connector set according to a twelfth aspect, in the eleventh aspect, at least one of the projecting fixing terminal of the first connector and the recessed fixing terminal of the second connector and the wall-shaped terminal may be formed of the same member, and a connecting portion of these may be connected to the ground potential.

In the electric connector set according to a thirteenth aspect, in any of the first to twelfth aspects, at least one of the first connector and the second connector may have a metal terminal disposed in an annular shape over the entire circumference.

With the above configuration, noise immunity can be improved. Further, the ease of impedance matching can be improved.

In the electric connector set according to a fourteenth aspect, in any of the first to thirteenth aspects, the first engaging terminal may have a multi-pole configuration of two rows along the first direction, and the electric connector set may further include a second wall-shaped terminal disposed between two adjacent ones of the first engaging terminals.

The above configuration allows the first engaging terminal to transmit digital signals and other signals.

In the electric connector set according to a fifteenth aspect, in any of the first to fourteenth aspects, in the first engaging terminal, a portion projecting from a portion where the first projecting terminal and the first recessed terminal are spring-engaged to both sides along the second direction may be placed on the inner side than a range extending along the second direction of the wall-shaped terminal.

With the above configuration, the length from the soldering of the mounting portion to the spring-engaged portion can be shortened, and the stray capacitance can be reduced, so that the impedance adjusting portion can be easily configured.

In the electric connector set according to a sixteenth aspect, in any of the first to fifteenth aspects, the wall-shaped terminal may be attachable to and removable from the first connector or the second connector, and, on at least one of the first connector and the second connector, the wall-shaped terminal may be able to be disposed in at least one location along the first direction.

In the electric connector set according to a seventeenth aspect, in any of the first to tenth aspects, the first engaging terminal may be a millimeter wave connection terminal, and a total thickness in the fitting direction of the first connector and the second connector may be equal to or less than 1 mm.

In the electric connector set according to an eighteenth aspect, in any of the first to the seventeenth aspects, the second engaging terminal may have a multi-pole configuration of two rows along the first direction.

The above configuration allows the second engaging terminal to transmit digital signals and other signals.

Hereinafter, the electric connector set according to embodiments will be described with reference to the attached drawings. Note that, in the drawings, substantially the same members are designated by the same reference numerals.

First Embodiment

Figure 1B:
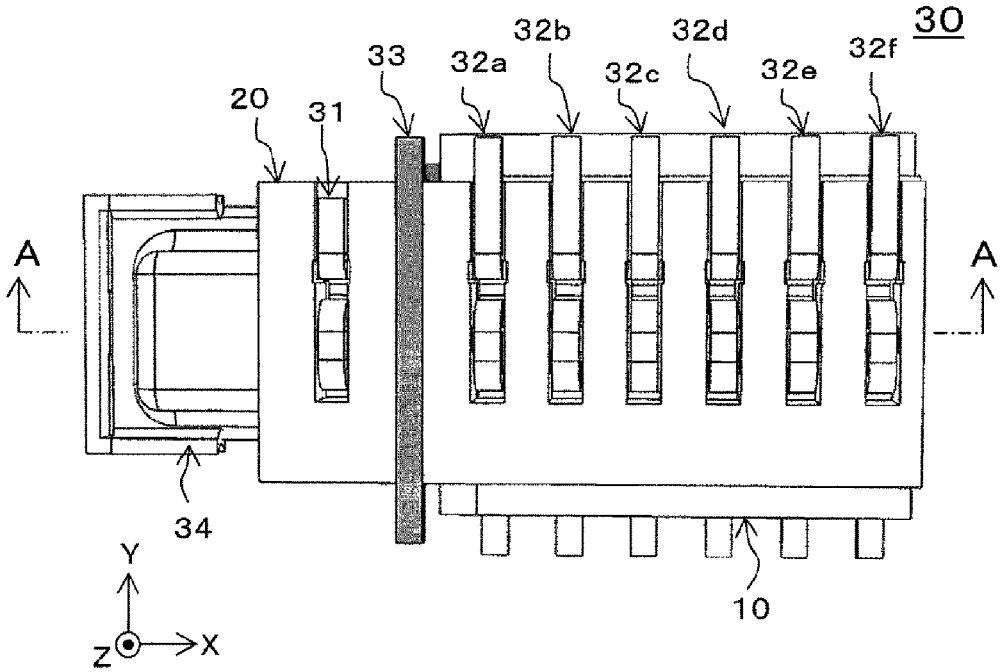
FIG. 1B is a plan view of the electric connector set of FIG. 1A.

FIG. 1A is a schematic perspective view of an electric connector set 30 according to a first embodiment. FIG. 1B is a plan view of the electric connector set 30 of FIG. 1A.

Figure 1C:
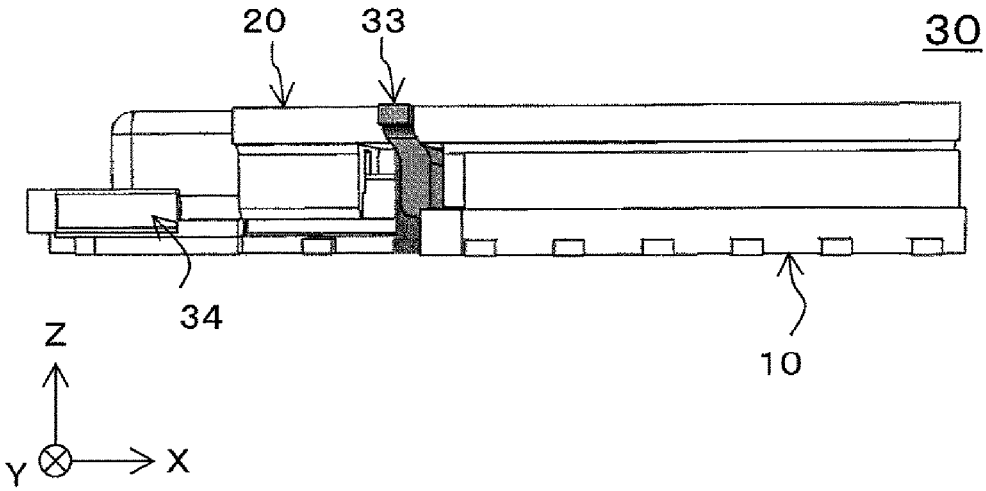
FIG. 1C is a side view of the electric connector set of FIG. 1A.
Figure 2:
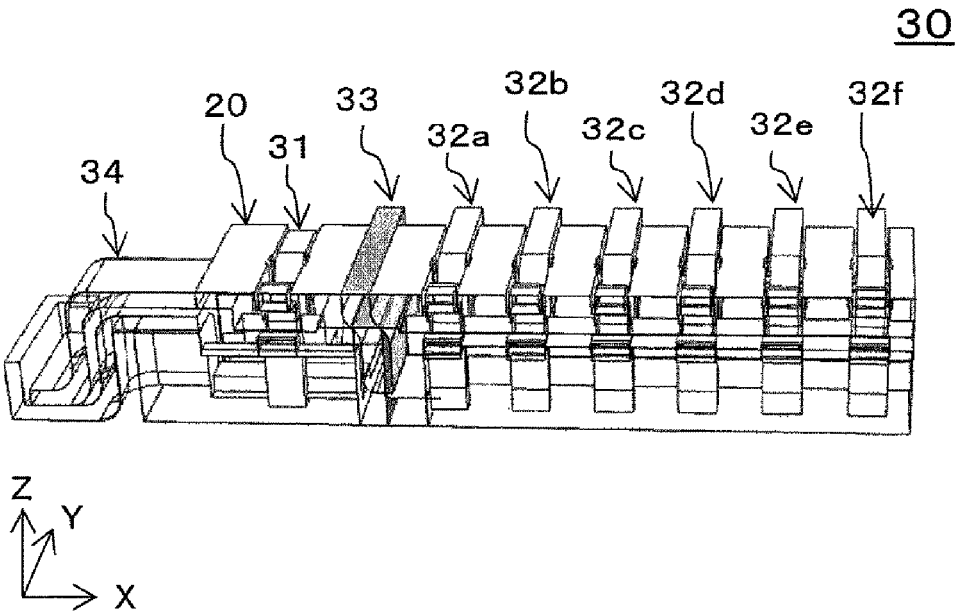
FIG. 2 is a schematic sectional view which shows a sectional structure cut along line A-A of FIG. 1B.

FIG. 1C is a side view of the electric connector set 30 of FIG. 1A. FIG. 2 is a schematic sectional view which shows a sectional structure cut along line A-A of FIG. 1B. Note that, in the drawings, for convenience, the fitting direction of a first connector 10 and a second connector 20 is shown as the z-axis direction. Further, the arrangement direction of a first engaging terminal 31, a wall-shaped terminal 33, and second engaging terminals 32*a* to 32*f* is the x-axis direction, and the extending direction of the wall-shaped terminal 33 is the y-axis direction.

The electric connector set 30 according to the first embodiment is configured such that the first connector 10 and the second connector 20 face each other and are fitted in the z-axis direction. The electric connector set 30 is characterized in that the wall-shaped terminal 33 is disposed between the first engaging terminal 31 and the second engaging terminals 32*a* to 32*f*. The first engaging terminal 31 is configured such that a first projecting terminal 11 of the first connector 10 and a first recessed terminal 21 of the second connector 20 are spring-engaged. The second engaging terminals 32*a* to 32*f* are configured such that second projecting terminals 12*a* to 12*f* of the first connector 10 and second recessed terminals 22*a* to 22*f* of the second connector 20 are spring-engaged. The second engaging terminals 32*a* to 32*f* are disposed along the first direction (x-axis direction). Further, the wall-shaped terminal 33 extends in the y-axis direction over a region including an outer shape of a projection region in the x-axis direction of a portion where the first projecting terminal 11 of the first connector 10 and the first recessed terminal 21 of the second connector 20 constituting the first engaging terminal 31 are spring-engaged. The wall-shaped terminal 33 has a height substantially the same as the height in the fitting direction (z-axis direction) of the electric connector set 30.

With the above configuration, since the wall-shaped terminal 33 is provided between the first engaging terminal 31 used for high frequency transmission and the other second engaging terminals 32*a* to 32*f*, the radiation of electromagnetic waves from the first engaging terminal 31 can be shielded, and the resonance of the first engaging terminal 31 can be suppressed even in high frequency transmission.

Note that, as shown in FIG. 1A, the electric connector set 30 includes, but is not limited to, one block 46 formed of the first engaging terminal 31 and the wall-shaped terminal 33. For example, as shown in second and third embodiments described later, two or more of blocks 46*a* and 46*b* as shown in, for example, FIGS. 13A and 13B, which are formed of the first engaging terminal 31 and the wall-shaped terminal 33, may be included. In this manner, the number of transmission signal lines can be increased. Further, in FIG. 1A, a block formed of the first engaging terminal and the wall-shaped terminal is disposed at one end of the electric connector set. However, the configuration is not limited to this, and, for example, the block may be located at the center of the electric connector set. This makes it possible to improve the degree of freedom in designing the transmission signal line. In this case, the wall-shaped terminals may be provided between the first engaging terminal and the second engaging terminals adjacent on both sides.

Further, the electric connector set 30 may further have a fixing terminal 34 having a locking mechanism 15 for holding the first connector 10 and the second connector 20 in the fitting direction (z-axis direction).

Hereinafter, each member constituting the electric connector set will be described.

<First Engaging Terminal>

Figure 3A:
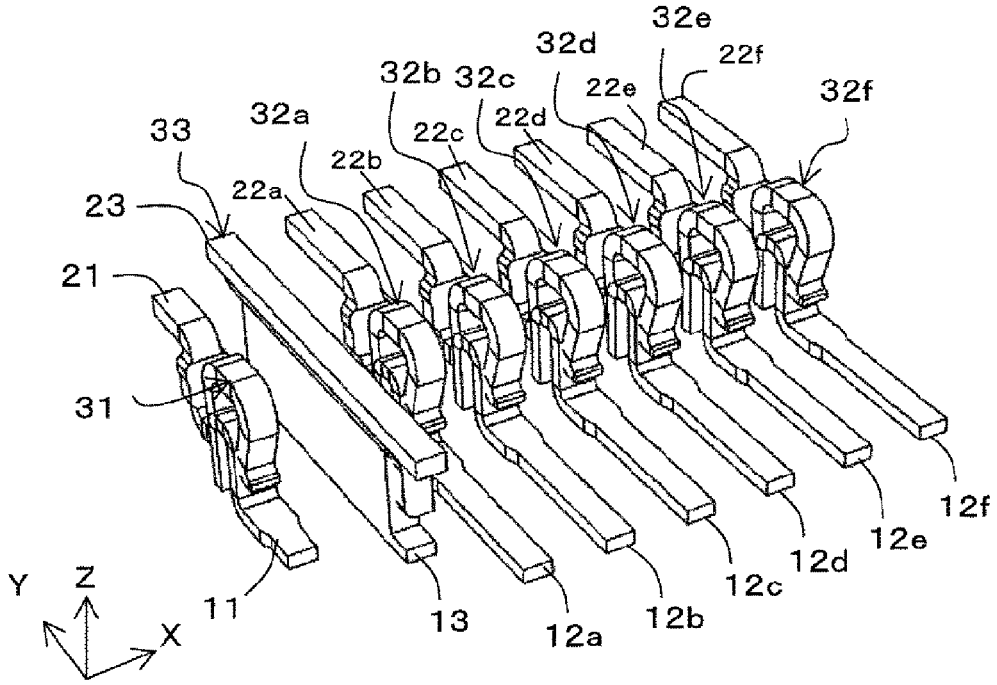
FIG. 3A is a schematic partial perspective view which shows an arrangement relationship between a first engaging terminal, a second engaging terminal, and a wall-shaped terminal of the electric connector set according to the first embodiment.
Figure 3B:
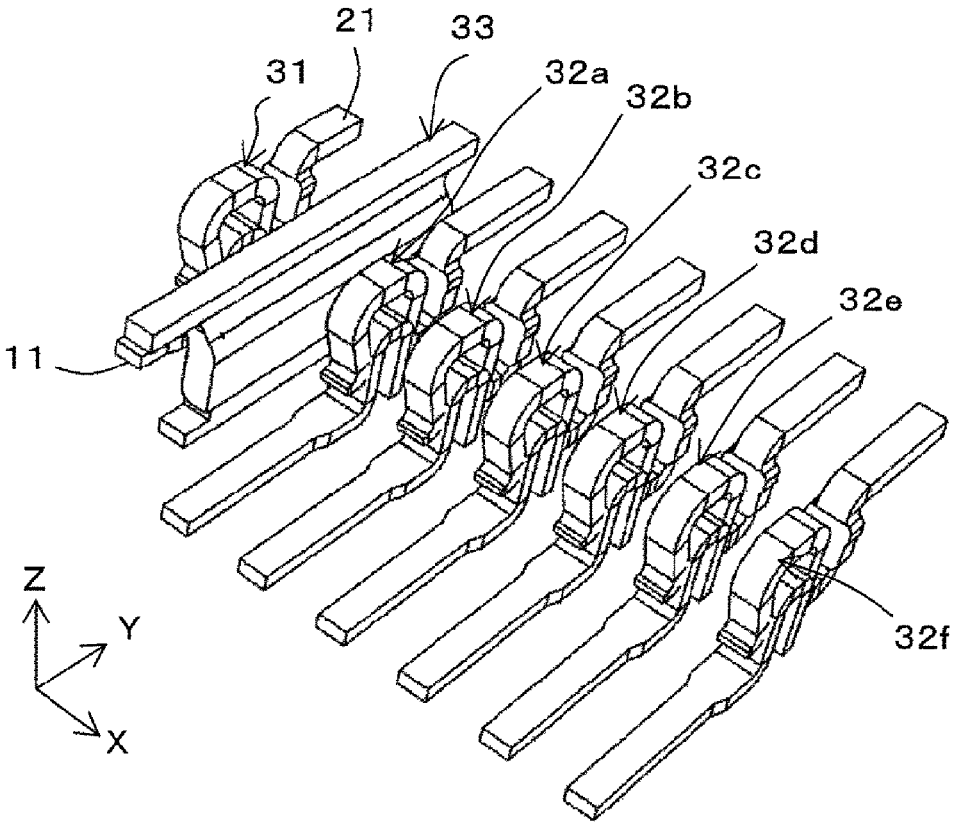
FIG. 3B is a schematic partial perspective view showing an arrangement relationship between the first engaging terminal, the second engaging terminal, and the wall-shaped terminal when viewed from a direction different from that of FIG. 3A.

FIG. 3A is a schematic partial perspective view which shows an arrangement relationship between the first engaging terminal 31, the second engaging terminals 32*a* to 32*f*, and the wall-shaped terminal 33 of the electric connector set 30 according to the first embodiment. FIG. 3B is a schematic partial perspective view showing an arrangement relationship between the first engaging terminal 31, the second engaging terminals 32*a* to 32*f*, and the wall-shaped terminal 33 when viewed from a direction different from that of FIG. 3A. The first engaging terminal 31 is configured such that a first projecting terminal 11 of the first connector 10 and a first recessed terminal 21 of the second connector 20 are spring-engaged. Note that the first projecting terminal 11 of the first connector 10 and the first recessed terminal 21 of the second connector 20 may be opposite to each other. For example, the first engaging terminal may be configured such that the first recessed terminal of the first connector and the first projecting terminal of the second connector are spring-engaged.

The first engaging terminal 31 may be, for example, a connection terminal for millimeter wave signal transmission. Note that the millimeter wave has a wavelength in the range of 1 mm to 10 mm and a frequency in the range of about 30 GHz to about 300 GHz. The first engaging terminal 31 may be, for example, a connection terminal for millimeter wave signal transmission in the range of 40 GHz to 100 GHz. Further, in the first engaging terminal 31, portions protruding in the +y direction and the −y direction from the spring-engaged portion are on the inner side than the range in the y-axis direction of the wall-shaped terminal 33. In this manner, the length from the soldering of the mounting portion to the spring-engaged portion can be shortened, and the stray capacitance can be reduced, so that the impedance adjusting portion can be easily configured. Furthermore, although only one of the first engaging terminal 31 is shown here, a plurality of the first engaging terminals 31 may be disposed. In this case, a multi-pole configuration having two or more rows along the x-axis direction may be used. Further, a plurality of the first engaging terminals 31 may be disposed along the x-axis direction. In these cases, a second wall-shaped terminal disposed between two adjacent ones of the first engaging terminals 31 is further included. This allows the first engaging terminal to transmit digital signals and other signals.

<Second Engaging Terminal>

The second engaging terminals 32*a* to 32*f* are configured such that the second projecting terminals 12*a* to 12*f* of the first connector 10 and the second recessed terminals 22*a* to 22*f* of the second connector 20 are spring-engaged. The second engaging terminals 32*a* to 32*f* are disposed along the first direction (x-axis direction). Note that the second projecting terminals 12*a* to 12*f* of the first connector 10 and the second recessed terminals 22*a* to 22*f* of the second connector 20 may be opposite to each other. For example, the second engaging terminal may be configured such that the second recessed terminal of the first connector and the second projecting terminal of the second connector are spring-engaged. Further, the second engaging terminals 32*a* to 32*f* may have a multi-pole configuration of two or more rows along the x-axis direction. This allows the second engaging terminal to transmit digital signals and other signals. Note that, when viewed from the x-axis direction, the length in the −y-axis direction of the second projecting terminals 12*a* to 12*f* of the second engaging terminals 32*a* to 32*f* is larger than the length in the −y-axis direction of the first projecting terminal 11 of the first engaging terminal 31. That is, the length in the −y-axis direction of 11<the length in the −y-axis direction of 12*a* to 12*f*. Further, when viewed from the x-axis direction, the length in the y-axis direction of the second recessed terminals 22*a* to 22*f* of the second engaging terminals 32*a* to 32*f* is larger than the length in the y-axis direction of the first recessed terminal 21 of the first engaging terminal 31. That is, the length in the y-axis direction of 21<the length in the y-axis direction of 22*a* to 22*f*.

Also, the height of the wall-shaped terminals, such as wall-shaped terminal 33, may have the same height as the electrical connector set 30 in the mating direction (i.e., the z-axis direction in which the first connector 10 and the second connector 20 mate with each other, as shown in FIG. 1C), or the height of the wall-shaped terminal 33 may be higher than the height of the electrical connector set 30 in the mating direction, and can thus shield electromagnetic waves. However, in order to reduce the size of the connector set 30, it is preferable that the height of the wall-shaped terminal 33 has approximately the same height as the height of the electrical connector set 30 in the mating direction, as shown, for example, in FIG. 1C.

<Wall-Shaped Terminal>

Figure 4:
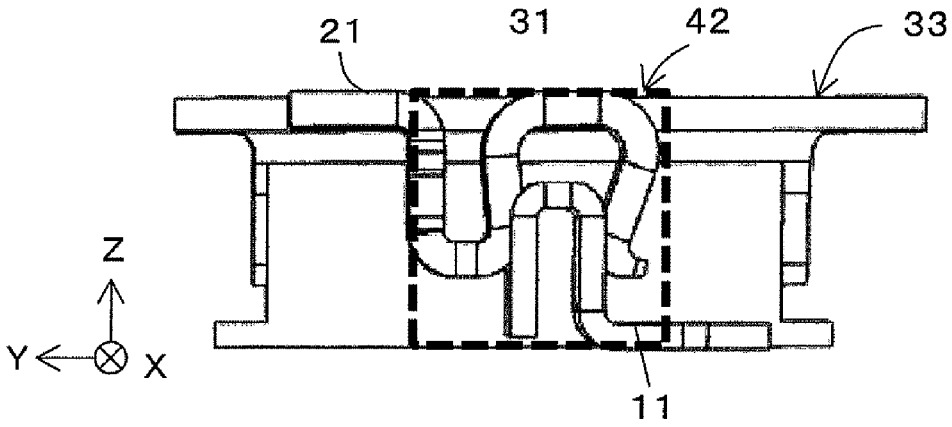
FIG. 4 is a schematic diagram which shows a relationship between a projection region of a spring engaging portion of the first engaging terminal and a wall-shaped terminal viewed from the negative side in the x-axis direction toward the positive side.
Figure 5A:
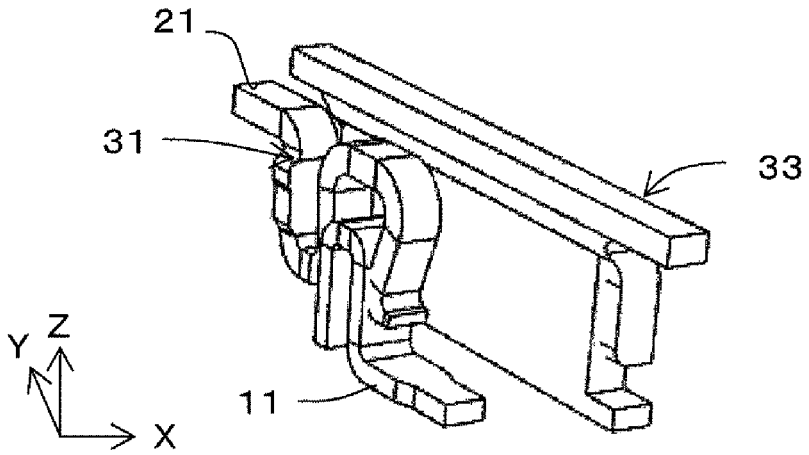
FIG. 5A is a schematic perspective view which shows an arrangement relationship between the first engaging terminal and the wall-shaped terminal.
Figure 5B:
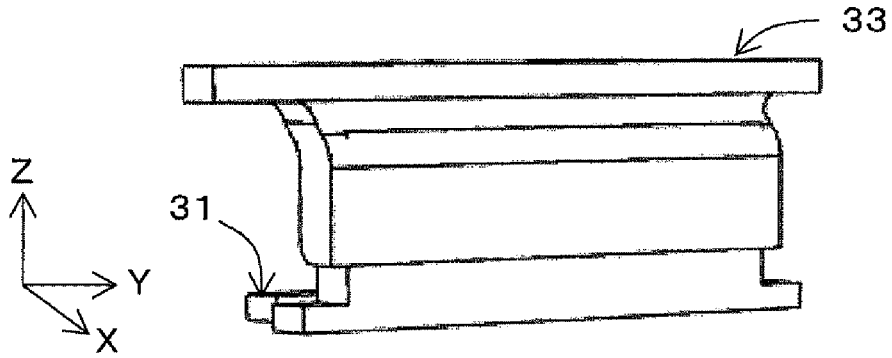
FIG. 5B is a schematic perspective view showing an arrangement relationship between the first engaging terminal and the wall-shaped terminal when viewed from a direction different from that of FIG. 5A.

FIG. 4 is a schematic diagram which shows a relationship between an outer shape including region 42 of a projection region of a spring engaging portion of the first engaging terminal 31 and the wall-shaped terminal 33 viewed from the negative side in the x-axis direction toward the positive side. FIG. 5A is a schematic perspective view which shows an arrangement relationship between the first engaging terminal 31 and the wall-shaped terminal 33. FIG. 5B is a schematic perspective view showing an arrangement relationship between the first engaging terminal 31 and the wall-shaped terminal 33 when viewed from a direction different from that of FIG. 5A. The wall-shaped terminal 33 is disposed between the first engaging terminal 31 and the second engaging terminals 32*a* to 32*f*. As shown in FIG. 4, the wall-shaped terminal 33 extends in the y-axis direction over the outer shape including region 42 including an outer shape of a projection region from the x-axis direction of a portion where the first projecting terminal 11 of the first connector 10 and the first recessed terminal 21 of the second connector 20 constituting the first engaging terminal 31 are spring-engaged. Further, as shown in FIGS. 4, 5A, and 5B, the wall-shaped terminal 33 has substantially the same height as the height in the fitting direction (z-axis direction) of the electric connector set 30. That is, when viewed from the second engaging terminal 32, as shown in FIG. 5B, the first engaging terminal 31 is completely covered by the wall-shaped terminal 33. In this manner, the wall-shaped terminal 33 can separate the first engaging terminal 31 from the second engaging terminal 32. Further, the wall-shaped terminal 33 may be made from a metal material. Furthermore, the wall-shaped terminal 33 may be connected to the ground potential. The wall-shaped terminal 33 can shield the electromagnetic wave radiated from the first engaging terminal 31. Furthermore, by setting the wall-shaped terminal 33 to have approximately the same height as the height in the fitting direction (z-axis direction) of the electric connector set 30, generation of unnecessary resonance of the GND terminal can be suppressed even for wavelengths in a high frequency band, for example, millimeter wave signal transmission.

Further, the wall-shaped terminal 33 may have a planar shape including the outer shape of the projection region of the first engaging terminal 31 from the x-axis direction. In this manner, it is possible to suppress the wraparound and radiation of the electric field of the transmission signal line. Therefore, the transmission signal line can be transmitted with an ideal coplanar configuration. Further, it becomes easy to capture the electric field of the transmission signal line. Therefore, the radiation loss of the transmission signal line can be suppressed. Further, the separability from other transmission signal lines in the electric connector set 30 can be improved. The planar shape is not limited to a flat plate shape, and may be a recessed or projecting shape including an uneven shape, or a curved surface shape including partial recessed and projecting portions. Alternatively, the wall-shaped terminal 33 may have a flat plate shape extending in the y-axis direction. Note that the wall-shaped terminal 33 does not have to have a constant in-plane thickness in the x-axis direction. Further, the wall-shaped terminal may have at least a portion having a strip shape, a comb shape, a net shape, or the like. Note that the wall-shaped terminal may have a hole or a notch having a size so as not to leak the electromagnetic wave as long as the wall-shaped terminal can shield the electromagnetic wave radiated from the first engaging terminal 31. For example, the hole preferably has the longest distance of a straight line portion that can be taken inside the hole that is equal to or less than the wavelength of the electromagnetic wave radiated from the first engaging terminal.

Further, the wall-shaped terminal 33 may be formed of one member, or may be formed of two or more members. Further, the wall-shaped terminal may be attachable to and removable from the first connector or the second connector. For example, a member to which the wall-shaped terminal can be fixed by fitting or inserting may be disposed in a plurality of locations in the first connector or the second connector. In this case, the configuration may be such that the wall-shaped terminal can be disposed in at least one location along the first direction in at least one of the first connector and the second connector. When the wall-shaped terminal 33 is formed of one member, the wall-shaped terminal 33 only needs to be provided in at least one of the first connector 10 and the second connector 20.

Figure 6A:
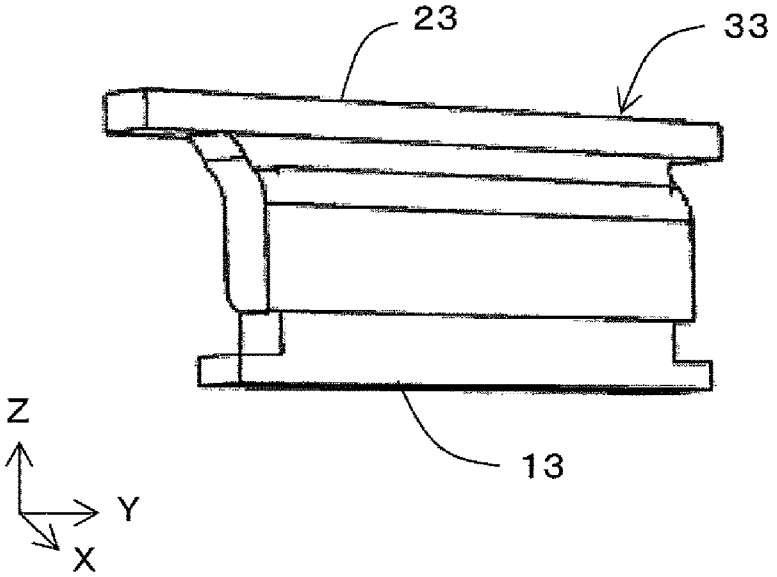
FIG. 6A is a schematic perspective view which shows a state in which the wall-shaped terminal is formed of a first partial wall terminal and a second partial wall terminal.
Figure 6B:
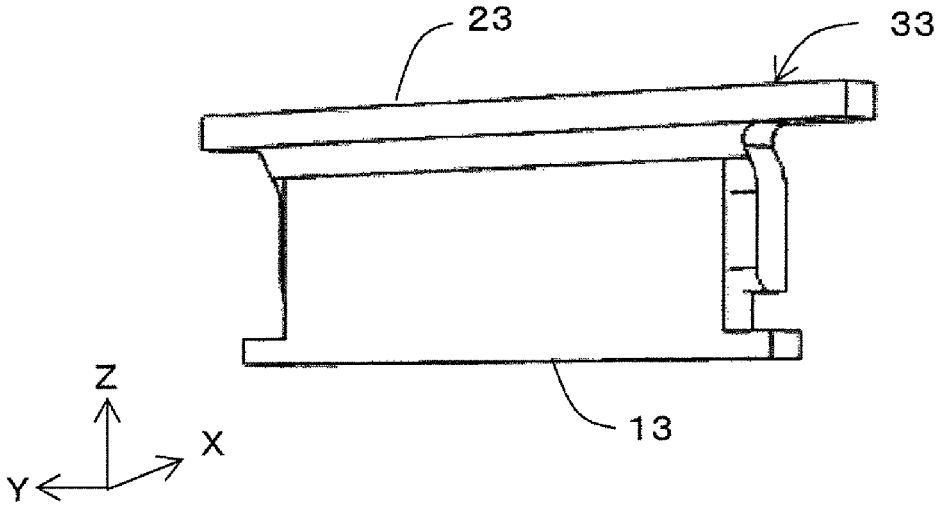
FIG. 6B is a schematic perspective view which shows the state in which the wall-shaped terminal is formed of the first partial wall terminal and the second partial wall terminal when viewed from a direction different from that of FIG. 6A.
Figure 7A:
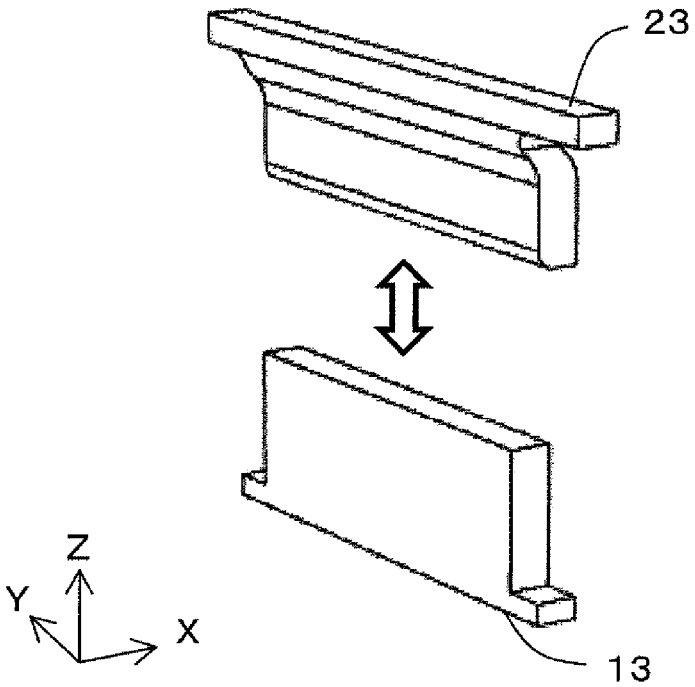
FIG. 7A is a schematic perspective view which shows a state at the time of fitting in which the first connector and the second connector are fitted, and the wall-shaped terminal is formed of the first partial wall terminal and the second partial wall terminal.
Figure 7B:
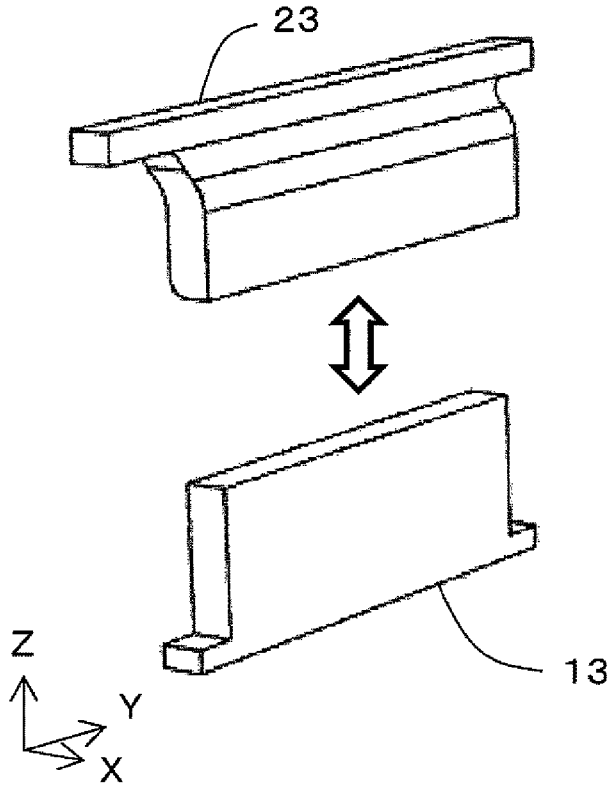
FIG. 7B is a schematic perspective view which shows the state at the time of fitting in which the first connector and the second connector are fitted, and the wall-shaped terminal is formed of the first partial wall terminal and the second partial wall terminal when viewed from a direction different from that of FIG. 7A.

FIG. 6A is a schematic perspective view which shows a state in which the wall-shaped terminal 33 is formed of a first partial wall terminal 13 and a second partial wall terminal 23. FIG. 6B is a schematic perspective view which shows the state in which the wall-shaped terminal 33 is formed of the first partial wall terminal 13 and the second partial wall terminal 23 when viewed from a direction different from that of FIG. 6A. FIG. 7A is a schematic perspective view which shows a state at the time of fitting in which the first connector 10 and the second connector 20 are fitted, and the wall-shaped terminal 33 is formed of the first partial wall terminal 13 and the second partial wall terminal 23. FIG. 7B is a schematic perspective view which shows the state at the time of fitting in which the first connector 10 and the second connector 20 are fitted, and the wall-shaped terminal 33 is formed of the first partial wall terminal 13 and the second partial wall terminal 23 when viewed from a direction different from that of FIG. 7A.

Figure 15A:
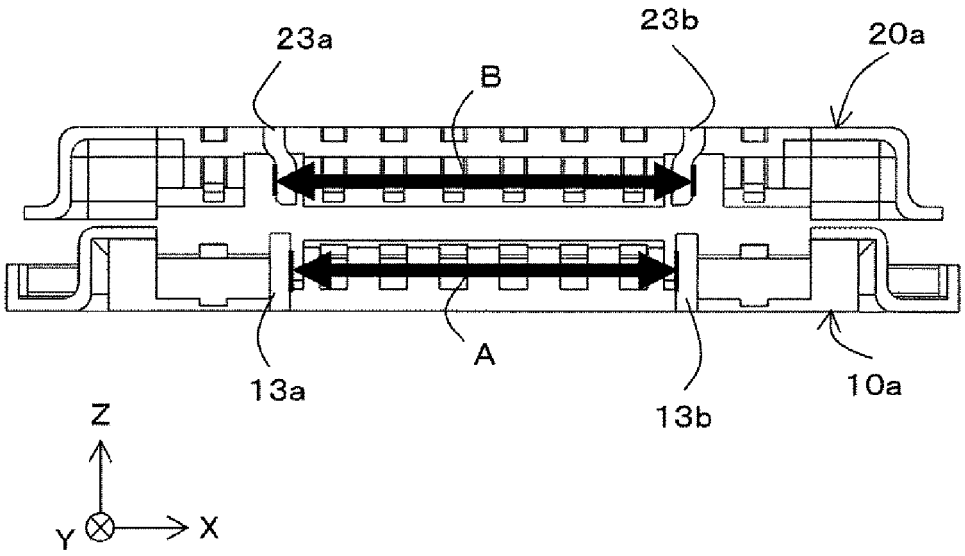
FIG. 15A is a schematic sectional view showing a state in which the first connector and the second connector are overlapped in a fitting direction in a modified example of the electric connector set according to the second embodiment.
Figure 15B:
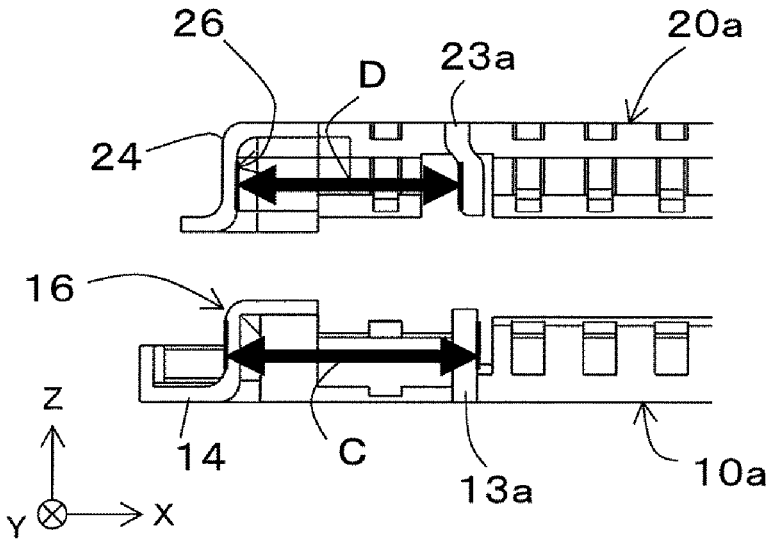
FIG. 15B is a schematic partial sectional view showing the state in which the first connector and the second connector are overlapped in the fitting direction in the electric connector set according to the second embodiment.

Next, as shown in FIGS. 6A and 6B, a case where the wall-shaped terminal 33 is configured by engagement of the first partial wall terminal 13 of the first connector 10 and the second partial wall terminal 23 of the second connector 20 will be described. In this case, the wall-shaped terminal 33 is not a single member, but is configured such that the first partial wall terminal 13 and the second partial wall terminal 23 are engaged with each other. The first partial wall terminal 13 and the second partial wall terminal 23 are electrically connected. At least one of the first partial wall terminal 13 and the second partial wall terminal 23 has a spring property and may be elastically deformable, for example. In this manner, when the first partial wall terminal 13 and the second partial wall terminal 23 are engaged, at least one of the terminals is elastically deformed even if stress is applied, so that the first partial wall terminal 13 and the second partial wall terminal 23 can be stably engaged. In this case, the elastic deformation may take place not only in the z-axis direction but also in the x-axis direction as shown in FIG. 15A or 15B. This allows tolerance for a distance (dimension) difference or a distance (dimension) change in the x-axis direction. Further, the electric connection can be stabilized. Further, when engagement takes place in the z-axis direction, the first partial wall terminal 13 and the second partial wall terminal 23 may be disposed so as to be slightly out of alignment from each other in the x direction. For example, the first partial wall terminal 13 and the second partial wall terminal 23 may be disposed so as to be out of alignment from each other in a range of equal to or more than half the thickness of the partial wall terminals in the x direction and equal to or less than the thickness. In this manner, as shown in FIGS. 6A and 6B, when engaged, the first partial wall terminal 13 and the second partial wall terminal 23 can be shifted in the x direction and receive stress in the x-axis direction so as to be brought into close contact with each other.

Note that the lower surface of the wall-shaped terminal 33 may be connected to a substrate constituting the bottom surface of the entire first connector 10. Further, two of the wall-shaped terminals 33 may be provided so as to sandwich the first engaging terminal 31 from the −x direction and the +x direction. In this manner, the electromagnetic field from the outside toward the first engaging terminal 31 can be shielded, and the electromagnetic field radiated from the first engaging terminal 31 in the x-axis direction can be shielded. Therefore, the EMC performance can be improved.

<Fixing Terminal>

Figure 8:
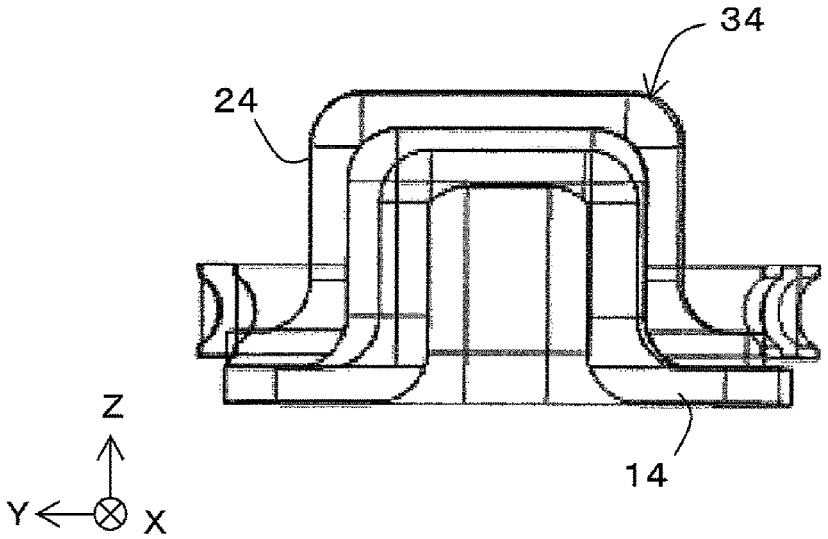
FIG. 8 is a sectional view which shows a sectional structure viewed from the x-axis direction of the fixing terminal of the electric connector set according to the first embodiment.
Figure 9:
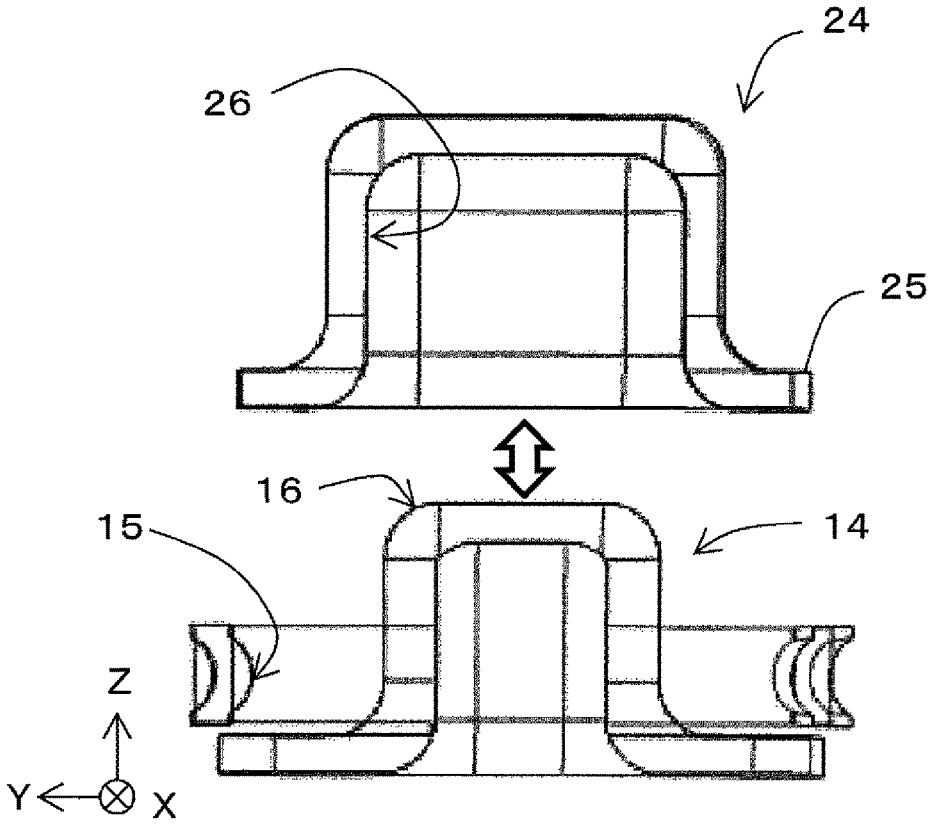
FIG. 9 is a schematic sectional view which shows a state at the time of fitting in which the first connector and the second connector are fitted, and the fixing terminal is formed of a projecting fixing terminal and a recessed fixing terminal.

FIG. 8 is a sectional view which shows a sectional structure viewed from the x-axis direction of the fixing terminal 34 of the electric connector set 30 according to the first embodiment. FIG. 9 is a schematic sectional view which shows a state at the time of fitting in which the first connector and the second connector are fitted, and the fixing terminal 34 is formed of a projecting fixing terminal 14 and a recessed fixing terminal 24. The fixing terminal 34 has the locking mechanism 15 for holding the first connector 10 and the second connector 20 in the fitting direction (z-axis direction). Specifically, a claw portion 25 of the second connector 20 is held by the locking mechanism 15 of the first connector 10, so that the first connector 10 and the second connector 20 can be fixed. In this case, at least one of the claw portion 25 of the second connector 20 and the locking mechanism 15 of the first connector 10 is elastically deformed, and the claw portion 25 penetrates deep into the locking mechanism 15 and is fixed. Note that the bottom surface of the locking mechanism 15 functions as a movable lowest possible surface in the −z direction of the second connector 20. The lowest possible surface is, in this case, the surface located furthest in the −z direction in a movable region in the z direction of the second connector 20. Alternatively, a surface of the substrate constituting the bottom surface of the first connector 10 may be used as the lowest possible surface. In this manner, the claw portion 25 of the second connector 20 can be received on the lowest possible surface after fitting, and a height fluctuation after fitting can be suppressed. Therefore, the impedance of the transmission signal line can be easily adjusted. Further, as shown in FIGS. 8 and 9, the fixing terminal 34 is configured in such a manner that a projecting curved surface 16 made from metal of the projecting fixing terminal 14 of the first connector 10 and a recessed curved surface 26 made from metal of the recessed fixing terminal 24 of the second connector 20 are in contact with each other. That is, the projecting fixing terminal 14 and the recessed fixing terminal 24 are electrically connected. In this manner, the resonance generated between the fixing terminal 34 and the substrate of the electric connector set 30 can be suppressed.

<First Connector>

Figure 10A:
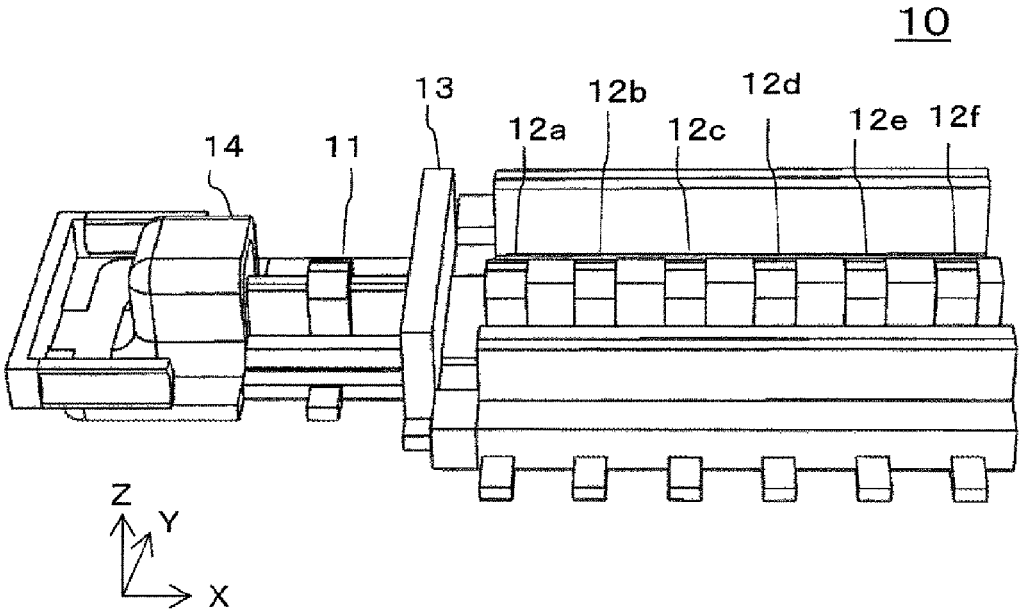
FIG. 10A is a schematic perspective view of the first connector constituting the electric connector set according to the first embodiment.
Figure 10B:
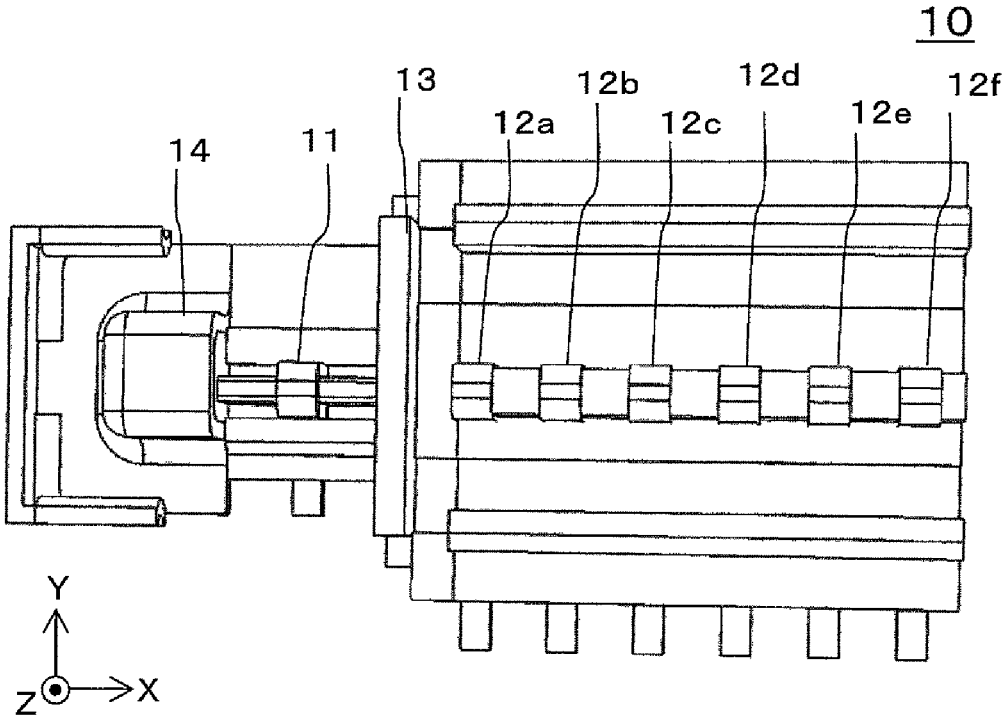
FIG. 10B is a plan view of the first connector of FIG. 10A.

FIG. 10A is a schematic perspective view of the first connector 10 constituting the electric connector set 30 according to the first embodiment. FIG. 10B is a plan view of the first connector 10 of FIG. 10A. In the first connector 10, the projecting fixing terminal 14, the first projecting terminal 11, the first partial wall terminal 13, and the second projecting terminals 12*a* to 12*f* are disposed along the x-axis direction. The first projecting terminal 11 and the second projecting terminals 12*a* to 12*f* may have a multi-pole configuration of two or more rows along the x-axis direction. The first projecting terminal 11 and the second projecting terminals 12*a* to 12*f* are spring-engageable members, and may be formed of, for example, phosphor bronze. As shown in FIGS. 10A and 10B, the first partial wall terminal 13 has a flat plate shape perpendicular to the x-axis direction. Note that an insulating member for disposing each member may be included. Further, a substrate electrically connected to the first partial wall terminal 13 may be provided on the bottom surface.

<Second Connector>

Figure 11A:
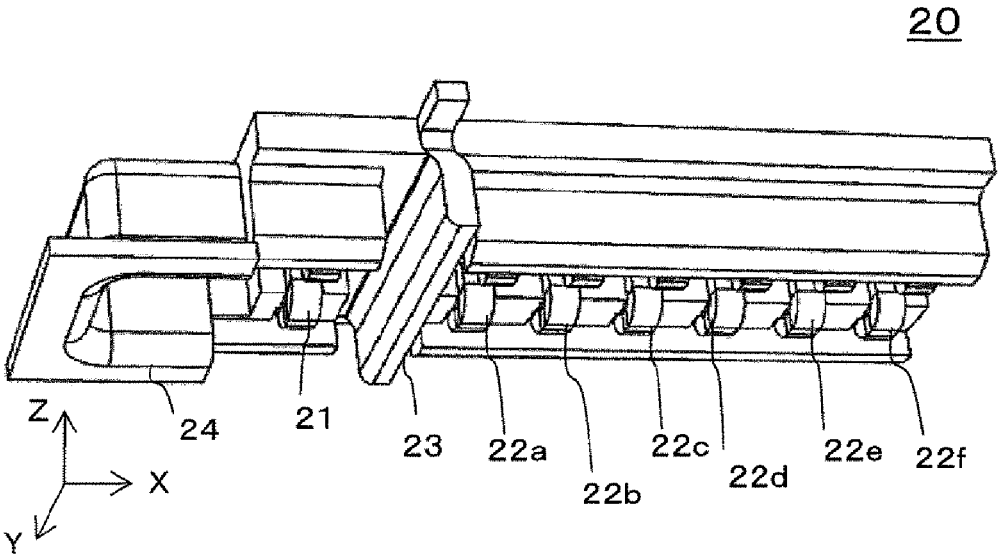
FIG. 11A is a schematic perspective view of the second connector constituting the electric connector set according to the first embodiment.
Figure 11B:
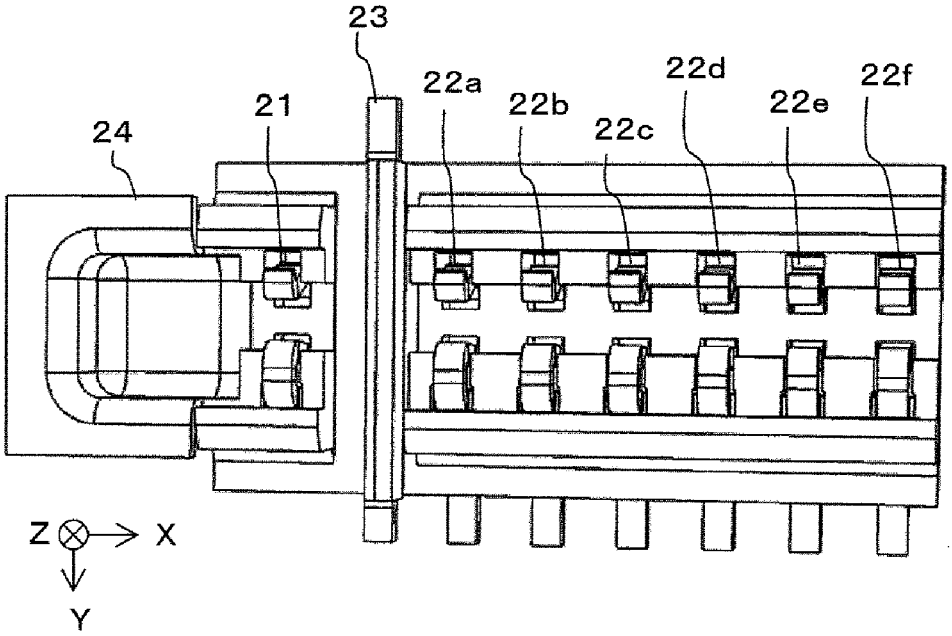
FIG. 11B is a bottom view of the second connector of FIG. 11A.

FIG. 11A is a schematic perspective view of the second connector 20 constituting the electric connector set 30 according to the first embodiment. FIG. 11B is a bottom view of the second connector 20 of FIG. 11A. In the second connector 20, the recessed fixing terminal 24, the first recessed terminal 21, the second partial wall terminal 23, and the second recessed terminals 22*a* to 22*f* are disposed along the x-axis direction. The first recessed terminal 21 and the second recessed terminals 22*a* to 22*f* are spring-engageable members, and may be formed of, for example, phosphor bronze. As shown in FIGS. 11A and 11B, the second partial wall terminal 23 has an upper end portion at substantially the same x position as the first partial wall terminal 13, and has a portion from a central portion to a lower end portion disposed in a manner shifted by around half the width in the x-axis direction with respect to the first partial wall terminal 13. In this manner, as shown in FIGS. 6A and 6B, when engaged, the first partial wall terminal 13 and the second partial wall terminal 23 can be shifted in the x-axis direction and receive stress in the x-axis direction so as to be brought into close contact with each other. Note that an insulating member for disposing each member may be included.

<Regarding Configuration of Electric Connector Set by Fitting First Connector and Second Connector>

Figure 12A:
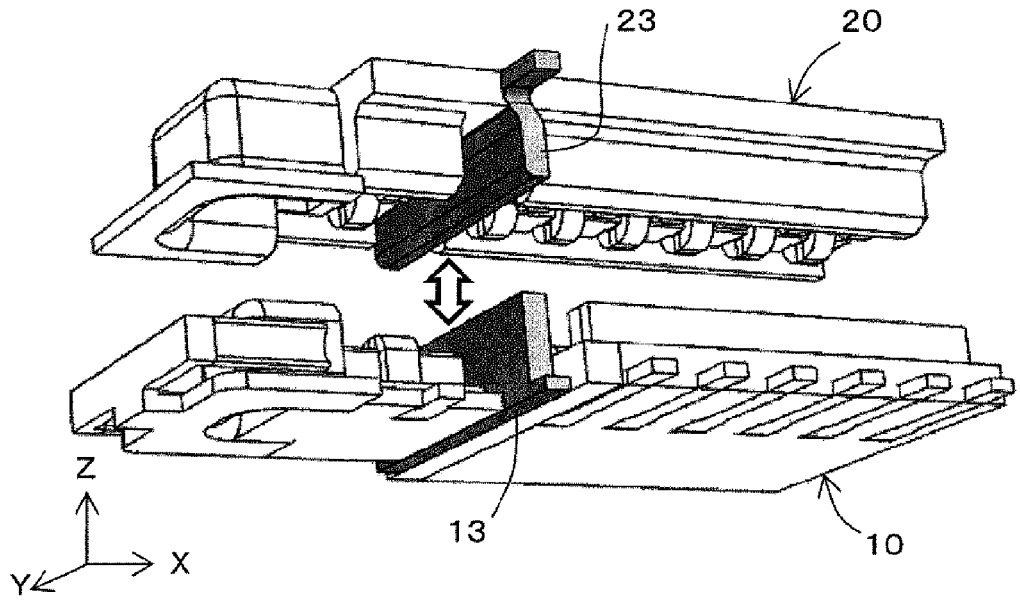
FIG. 12A is a schematic perspective view showing a state at the time of fitting, in which the electric connector set according to the first embodiment is configured by making the first connector and the second connector face each other and fitting them.
Figure 12B:
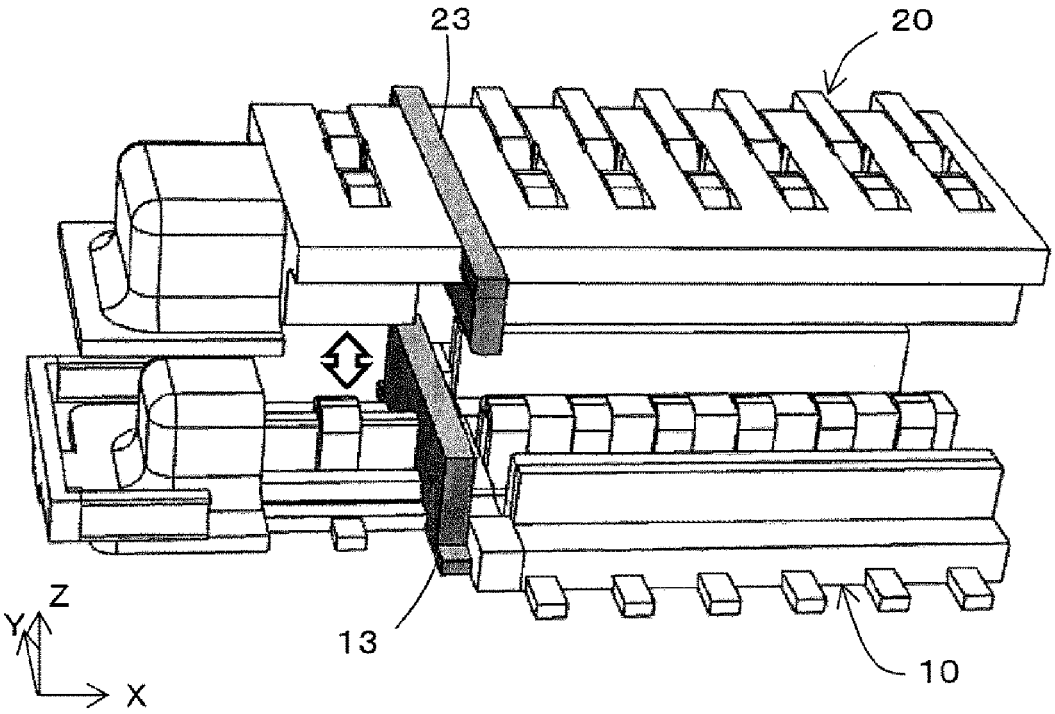
FIG. 12B is a schematic perspective view showing the state at the time of fitting, in which the electric connector set according to the first embodiment is configured by making the first connector and the second connector face each other and fitting them when viewed from a direction different from that of FIG. 12A.

FIG. 12A is a schematic perspective view showing a state at the time of fitting, in which the electric connector set 30 according to the first embodiment is configured by making the first connector 10 and the second connector 20 face each other and fitting them. FIG. 12B is a schematic perspective view showing the state at the time of fitting, in which the electric connector set 30 according to the first embodiment is configured by making the first connector 10 and the second connector 20 face each other and fitting them when viewed from a direction different from that of FIG. 12A.

The electric connector set 30 is configured by making the first connector 10 and the second connector 20 face each other and fitting them. At the time of fitting, the first projecting terminal 11 and the first recessed terminal 21 are engaged to constitute the first engaging terminal 31. Further, the second projecting terminals 12*a* to 12*f* and the second recessed terminals 22*a* to 22*f* are engaged to constitute the second engaging terminals 32*a* to 32*f*. Furthermore, the first partial wall terminal 13 and the second partial wall terminal 23 are engaged to constitute the wall-shaped terminal. Then, the projecting fixing terminal 14 and the recessed fixing terminal 24 are engaged to constitute the fixing terminal 34. As described above, the fixing terminal 34 holds the first connector 10 and the second connector 20 in the fitting direction (z-axis direction).

Second Embodiment

Figure 13A:
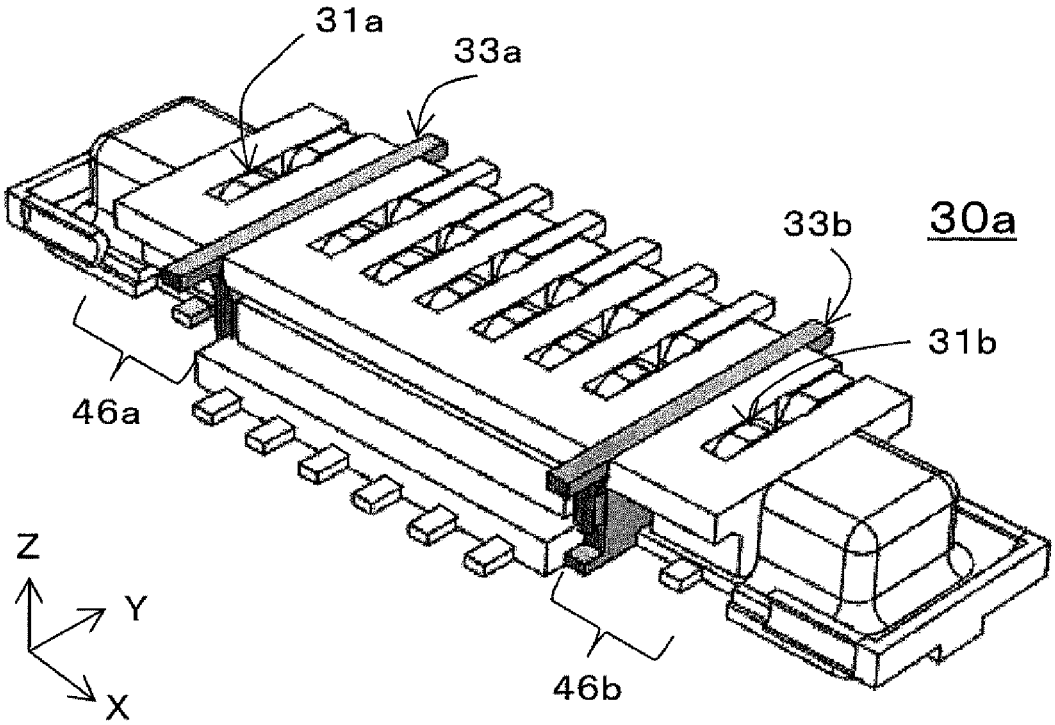
FIG. 13A is a schematic perspective view of the electric connector set according to a second embodiment.
Figure 13B:
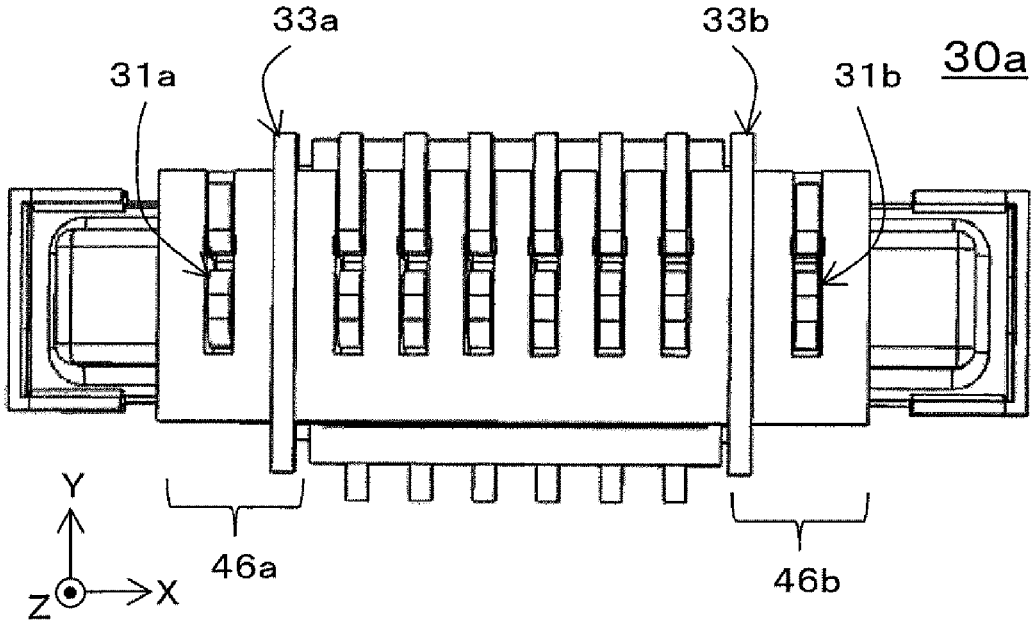
FIG. 13B is a plan view of FIG. 13A.
Figure 14A:
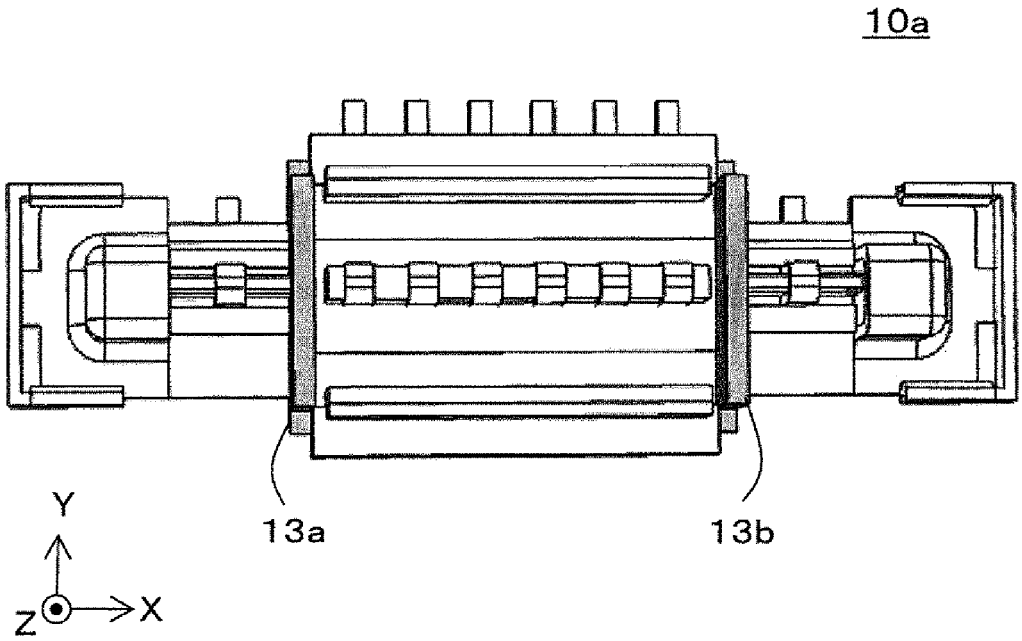
FIG. 14A is a plan view of the first connector constituting the electric connector set according to the second embodiment.
Figure 14B:
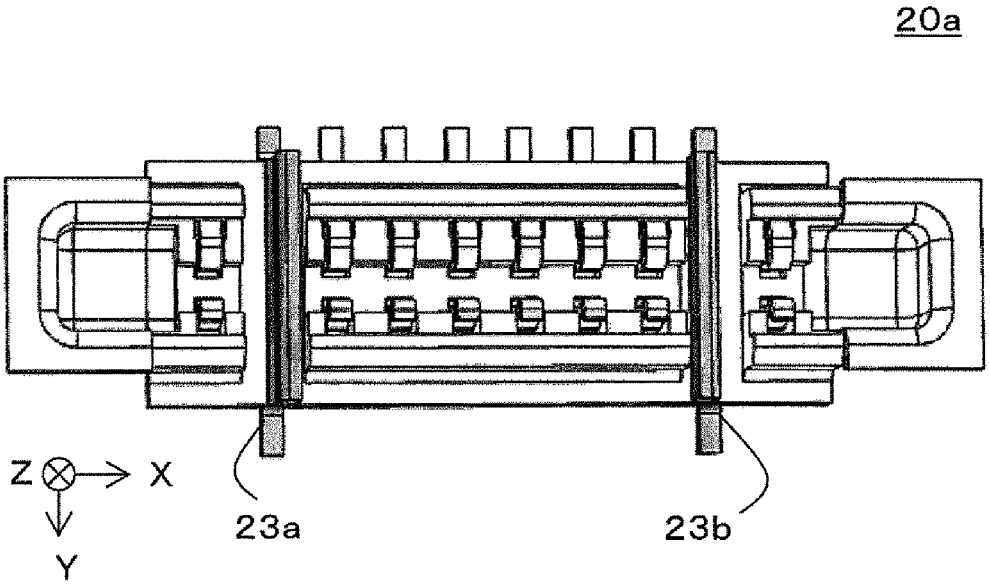
FIG. 14B is a bottom view of the second connector constituting the electric connector set according to the second embodiment.
Figure 15C:
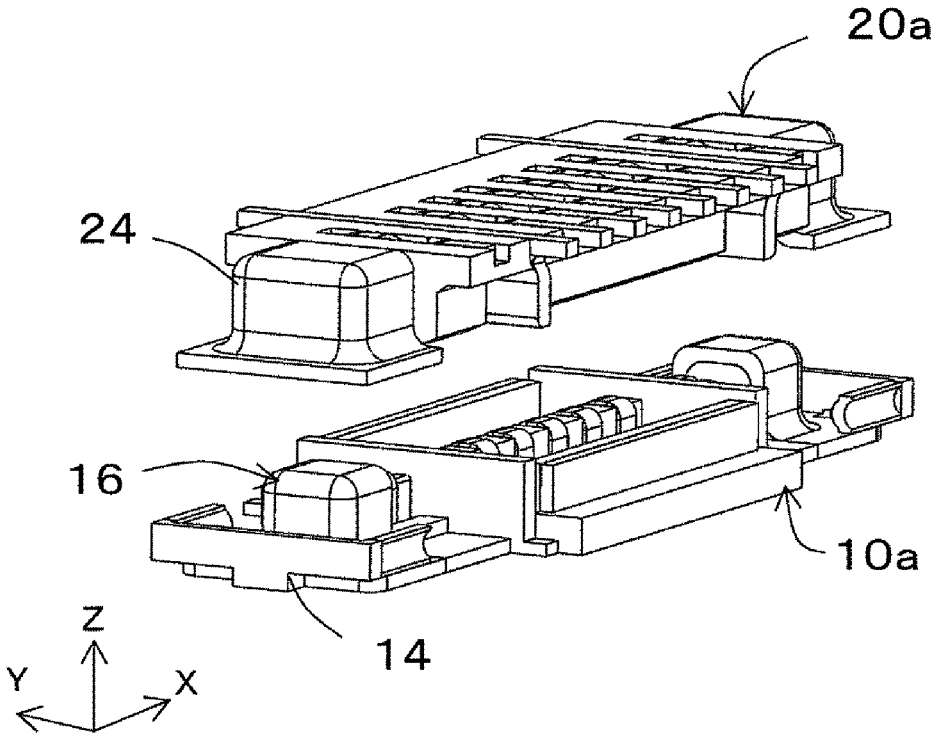
FIG. 15C is a schematic perspective view showing the state in which the first connector and the second connector are overlapped in the fitting direction in the electric connector set according to the second embodiment.

FIG. 13A is a schematic perspective view of an electric connector set 30*a* according to a second embodiment. FIG. 13B is a plan view of FIG. 13A. FIG. 14A is a plan view of a first connector 10*a* constituting the electric connector set 30*a* according to the second embodiment. FIG. 14B is a bottom view of the second connector 20*a* constituting the electric connector set 30*a* according to the second embodiment. FIG. 15B is a schematic partial sectional view showing a state in which a first connector 10*c* and a second connector 20*c* are overlapped in the fitting direction (z-axis direction) in the electric connector set according to a fourth embodiment. FIG. 15C is a schematic perspective view showing a state in which the first connector 10*c* and the second connector 20*c* are overlapped in the fitting direction (z-axis direction) in the electric connector set according to the fourth embodiment. As shown in FIGS. 13A and 13B, the electric connector set 30*a* according to the second embodiment has a block 46*a* of a wall-shaped terminal 33*a* and a first engaging terminal 31*a* and a block 46*b* of a wall-shaped terminal 33*b* and a first engaging terminal 31*b* at both ends in the x-axis direction. In this manner, the number of transmission signal lines can be increased.

Further, as shown in FIG. 15A, regarding a distance A in the x-axis direction between first partial wall terminals 13*a* and 13*b* of the blocks of the first connector 10*a* and a distance B in the x-axis direction between second partial wall terminals 23*a* and 23*b* of the blocks of the second connector 20*a*, a relationship of the distance A in the x-axis direction<the distance B in the x-axis direction is established. That is, even in a case where the distance A in the x-axis direction of the first connector 10*a* and the distance B in the x-axis direction of the second connector 20*a* are different with respect to the second engaging terminals 32*a* to 32*f* sandwiched between the two wall-shaped terminals 33*a* and 33*b*, the wall-shaped terminals 33*a* and 33*b* are elastically deformed, so that it is possible to prevent a positional relationship between the wall-shaped terminals 33*a* and 33*b* and the first engaging terminals 31*a* and 31*b* from being shifted in the x-axis direction. In this manner, the fluctuation of impedance can be reduced.

Furthermore, as shown in FIG. 15B, regarding a distance C in the x-axis direction between the inner side of the projecting curved surface 16 of the first connector 10*a* and the first partial wall terminal 13*a* and a distance D in the x-axis direction between the inner side of the recessed curved surface 26 of the second connector 20*a* and the second partial wall terminal 23*a*, a relationship of the distance C in the x-axis direction>the distance D in the x-axis direction is established. That is, even in a case where the first connector 10*a* and the second connector 20*a* are out of alignment in the x-axis direction at the time of fitting, the positional relationship between the wall-shaped terminal 33*a* and the first engaging terminal 31*a* can be prevented from being shifted due to the elastic deformation of the wall-shaped terminal 33*a*. In this manner, the fluctuation of impedance can be reduced.

Third Embodiment

Figure 16A:
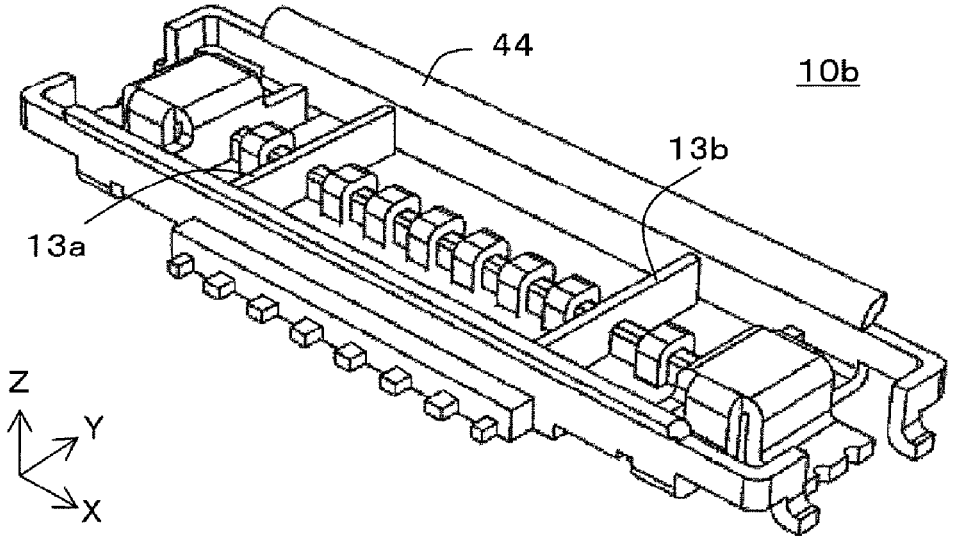
FIG. 16A is a schematic perspective view of the first connector constituting the electric connector set according to a third embodiment.
Figure 16B:
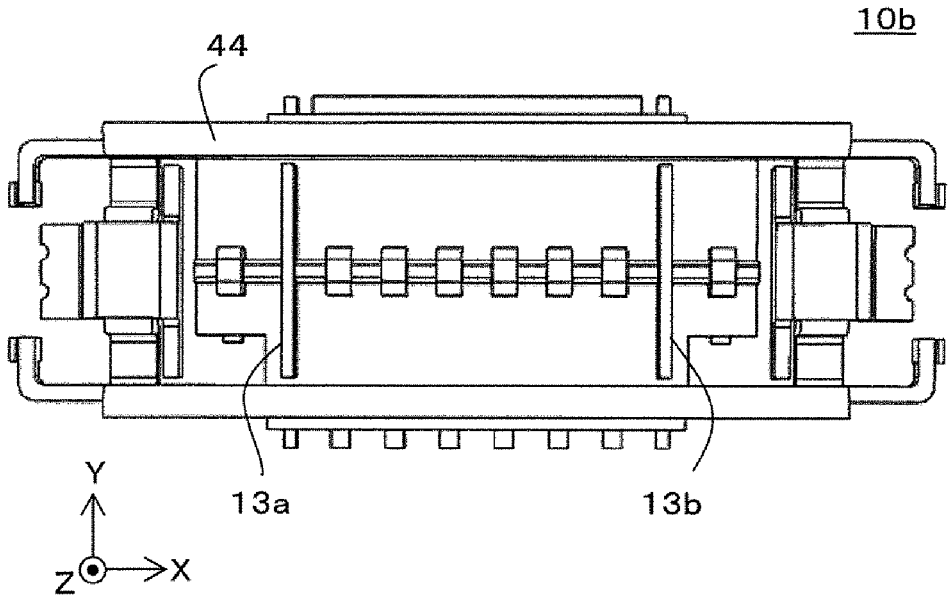
FIG. 16B is a plan view of the first connector of FIG. 16A.

FIG. 16A is a schematic perspective view of a first connector 10*b* constituting the electric connector set according to a third embodiment. FIG. 16B is a plan view of the first connector 10*b* of FIG. 16A. In comparison with the electric connector set according to the first and second embodiments, the electric connector set according to the third embodiment is different in that the first connector 10*b* has an annular outer metal terminal 44 disposed on the outer circumference, as shown in FIGS. 16A and 16B. Since the annular outer metal terminal is included as described above, noise immunity can be improved. Further, the ease of impedance matching can be improved.

Fourth Embodiment

Figure 17A:
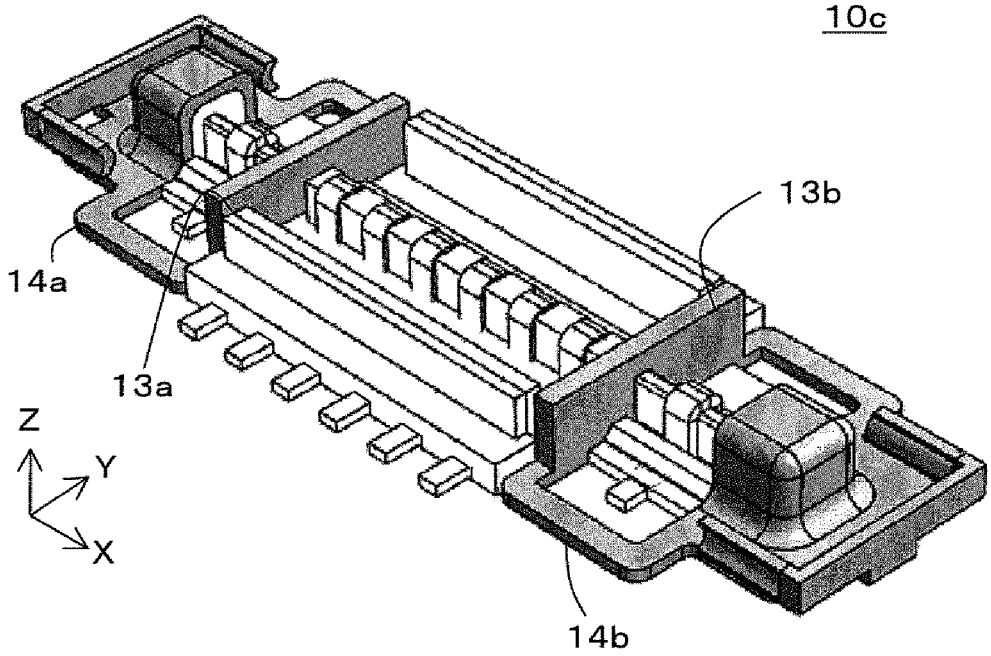
FIG. 17A is a schematic perspective view of the first connector constituting the electric connector set according to a fourth embodiment.
Figure 17B:
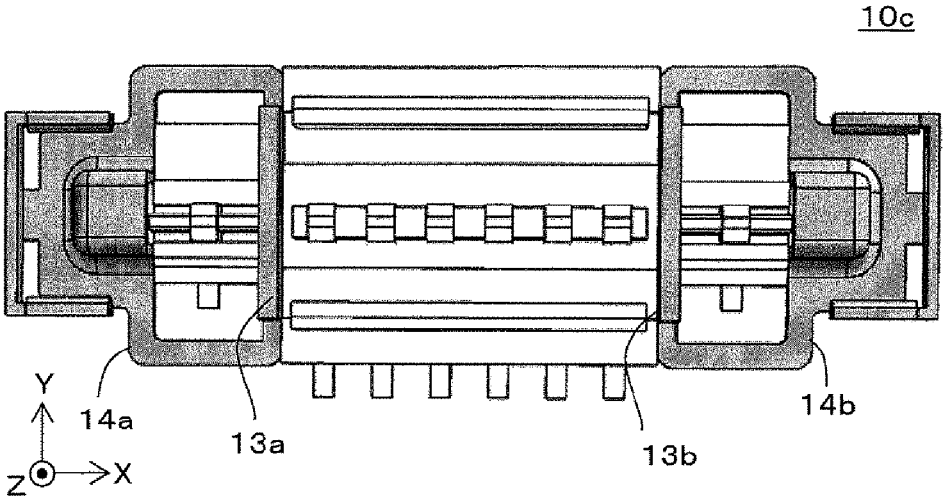
FIG. 17B is a plan view of the first connector of FIG. 17A.

FIG. 17A is a schematic perspective view of the first connector 10*c* constituting the electric connector set according to the fourth embodiment. FIG. 17B is a plan view of the first connector 10*c* of FIG. 17A. In the first connector 10*c* constituting the electric connector set according to the fourth embodiment, as shown in FIGS. 17A and 17B, the first partial wall terminal 13*a* and a projecting fixing terminal 14*a* are integrally formed of the same member. By forming the first partial wall terminal 13*a* and the projecting fixing terminal 14*a* with the same member as described above and grounding the connecting portion to the substrate, the potential difference between a fixing terminal 34*a* and the wall-shaped terminal 33*a* can be almost eliminated. Further, the noise immunity is improved, and the first partial wall terminal 13*a* and the projecting fixing terminal 14*a* can be integrally handled in the manufacturing process, so that the productivity can be improved.

Fifth Embodiment

Figure 18A:
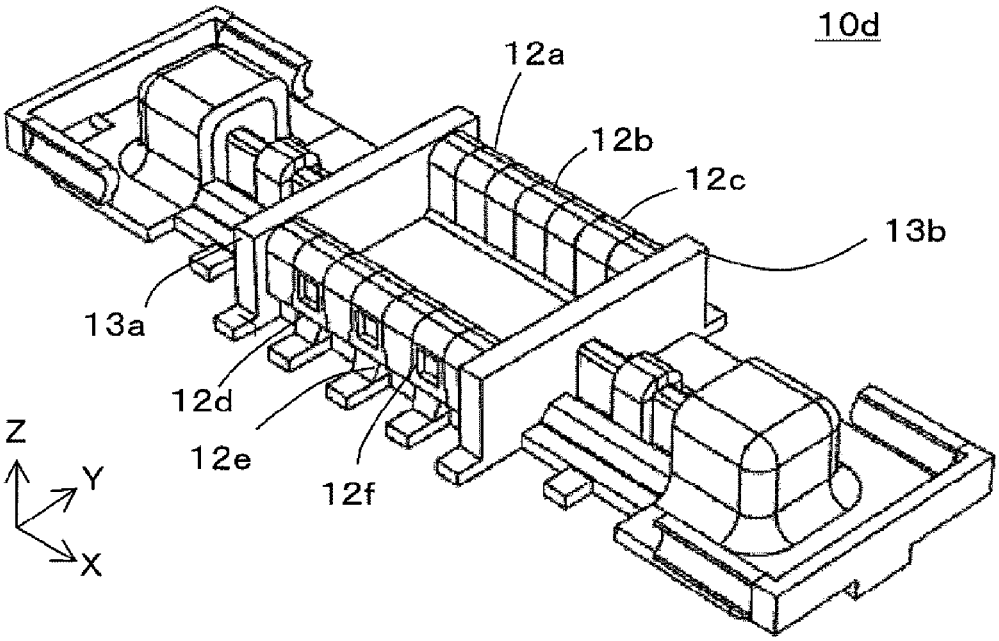
FIG. 18A is a schematic perspective view of the first connector constituting the electric connector set according to a fifth embodiment.
Figure 18B:
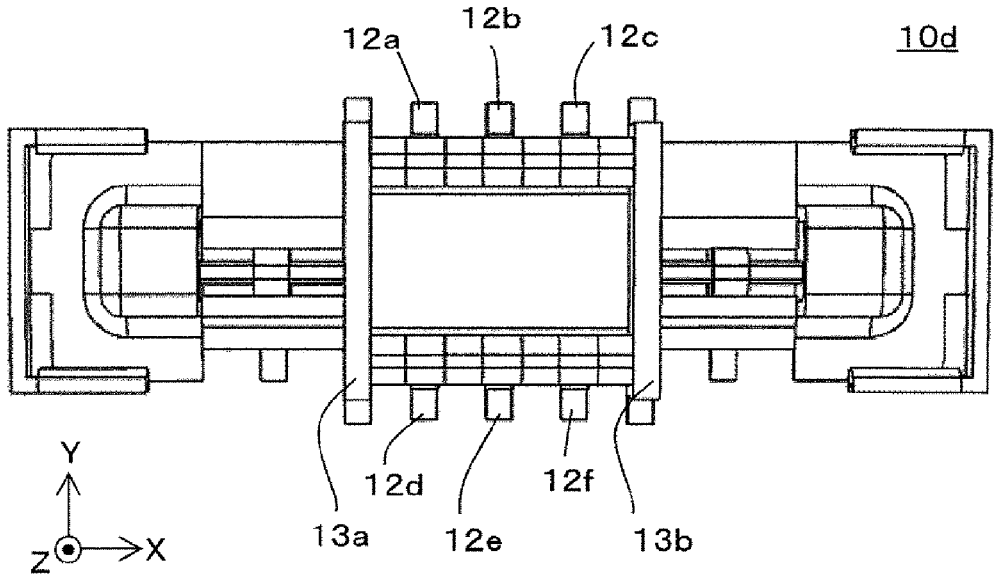
FIG. 18B is a plan view of the first connector of FIG. 18A.

FIG. 18A is a schematic perspective view of a first connector 10*d* constituting the electric connector set according to a fifth embodiment. FIG. 18B is a plan view of the first connector 10*d* of FIG. 18A. In the first connector 10*d* constituting the electric connector set according to the fifth embodiment, the second projecting terminals 12*a* to 12*f* are constituted in two rows extending in parallel along the x-axis direction. In this manner, the second engaging terminals 32*a* to 32*f* can be efficiently disposed, and the length in the x-axis direction can be shortened.

Note that the present disclosure includes appropriate combination of optional ones of the various embodiments and/or examples described above, and the effects of such embodiments and/or examples can be achieved.

According to the electric connector set according to the present disclosure, the wall-shaped terminal is provided between the first engaging terminal used for high frequency transmission and the other second engaging terminals. Accordingly, the electric connector set is useful as an electric connector set for high frequency transmission that can suppress resonance of the terminal.

What is claimed is:

1. An electric connector set configured by positioning a first connector and a second connector to face each other and fitting the first connector and the second connector together, the electric connector set comprising:

a first engaging terminal that is configured by spring engagement of a first projecting terminal of the first connector and a first recessed terminal of the second connector;

a second engaging terminal that is configured by spring engagement of a second projecting terminal of the first connector and a second recessed terminal of the second connector, and disposed along a first direction with respect to the first engaging terminal;

a wall-shaped terminal that is disposed between the first engaging terminal and the second engaging terminal in the first direction, and extends along a second direction crossing the first direction and a fitting direction over a region including an outer shape of a projection region in the first direction of a portion where the first projecting terminal of the first connector of the first engaging terminal and the first recessed terminal of the second connector are spring-engaged; and a third engaging terminal arranged adjacent to the second engaging terminal on a side opposite to the wall-shaped terminal, wherein no wall-shaped terminal is arranged between the second engaging terminal and the third engaging terminal, wherein the second engaging terminal has a greater length in the second dimension than the first engaging terminal, the first engaging terminal is configured for radio frequency transmission, and the second engaging terminal is configured for digital signal transmission.

2. The electric connector set according to claim 1, wherein the wall-shaped terminal is made from a metal material and is connected to a ground potential.

3. The electric connector set according to claim 1, wherein the wall-shaped terminal has a planar shape including an outer shape of a projection region of the first engaging terminal from the first direction.

4. The electric connector set according to claim 1, wherein the wall-shaped terminal is provided on at least one of the first connector and the second connector.

5. The electric connector set according to claim 1, wherein the wall-shaped terminal is configured by engagement of a first partial wall terminal of the first connector and a second partial wall terminal of the second connector.

6. The electric connector set according to claim 5, wherein at least one of the first partial wall terminal and the second partial wall terminal is elastically deformable.

7. The electric connector set according to claim 6, wherein blocks configured of the first engaging terminal and the wall-shaped terminal are provided in two locations along the first direction, and a length in the first direction between the first partial wall terminals of the blocks of the first connector is less than a length in the first direction between the second partial wall terminals of the blocks of the second connector.

8. The electric connector set according to claim 1, wherein blocks configured of the first engaging terminal and the wall-shaped terminal are provided in two locations along the first direction.

9. The electric connector set according to claim 6, further comprising:

a fixing terminal having a locking mechanism configured to hold the first connector and the second connector, wherein the fixing terminal is configured in such a manner that a projecting curved surface of a projecting fixing terminal of the first connector and a recessed curved surface of a recessed fixing terminal of the second connector are in contact with each other, and a length in the first direction of an inner side of the projecting curved surface of the first connector and the first partial wall terminal is greater than a length in the first direction of an inner side of the recessed curved surface of the second connector and the second partial wall terminal.

10. The electric connector set according to claim 1, further comprising:

a fixing terminal having a locking mechanism configured to hold the first connector and the second connector in the fitting direction.

11. The electric connector set according to claim 10, wherein the fixing terminal is configured such that a projecting curved surface of a projecting fixing terminal of the first connector and a recessed curved surface of a recessed fixing terminal of the second connector are in contact with each other.

12. The electric connector set according to claim 11, wherein at least one of the projecting fixing terminal of the first connector and the recessed fixing terminal of the second connector and the wall-shaped terminal are configured of a same member, and a connecting portion thereof is connected to a ground potential.

13. The electric connector set according to claim 1, wherein the first engaging terminal has a multi-pole configuration of two rows along the first direction, and the electric connector set further comprises a second wall-shaped terminal disposed between two adjacent ones of the first engaging terminals.

14. The electric connector set according to claim 1, wherein in the first engaging terminal, a portion projecting from a portion where the first projecting terminal and the first recessed terminal are spring-engaged to both sides along the second direction is placed on an inner side than a range extending along the second direction of the wall-shaped terminal.

15. The electric connector set according to claim 1, wherein the wall-shaped terminal is attachable to and removable from the first connector or the second connector, and on at least one of the first connector and the second connector, the wall-shaped terminal is positionable in at least one location along the first direction.

16. The electric connector set according to claim 1, wherein the first engaging terminal is a millimeter wave connection terminal, and a total thickness in the fitting direction of the first connector and the second connector is equal to or less than 1 mm.

17. The electric connector set according to claim 1, wherein the second engaging terminal has a multi-pole configuration of two rows along the first direction.

18. The electric connector set according to claim 2, wherein the wall-shaped terminal has a planar shape including an outer shape of a projection region of the first engaging terminal from the first direction.

19. The electric connector set according to claim 1, wherein the wall-shaped terminal has a same height as a height in a fitting direction of the electric connector set along which the first connector and the second connector are fitted together.

20. The electric connector set according to claim 1, wherein the second engaging terminal has a greater length in the second dimension than the wall-shaped terminal, and the wall-shaped terminal has a greater length in the second dimension than the first engaging terminal.

21. The electric connector set according to claim 1, wherein the electric connector includes only one first engaging terminal.

22. The electric connector set according to claim 1, wherein the third engaging terminal has a length in the second dimension equal to the length of the second engaging terminal in the second dimension.

* * * * *